US009581052B2

(12) United States Patent
Maehara

(10) Patent No.: US 9,581,052 B2
(45) Date of Patent: Feb. 28, 2017

(54) VARIABLE VALVE DEVICE

(71) Applicant: Toshiyuki Maehara, Susono (JP)

(72) Inventor: Toshiyuki Maehara, Susono (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 64 days.

(21) Appl. No.: 14/654,878

(22) PCT Filed: Dec. 25, 2012

(86) PCT No.: PCT/JP2012/083414
§ 371 (c)(1),
(2) Date: Jun. 23, 2015

(87) PCT Pub. No.: WO2014/102893
PCT Pub. Date: Jul. 3, 2014

(65) Prior Publication Data

US 2015/0330266 A1 Nov. 19, 2015

(51) Int. Cl.

| | |
|---|---|
| ***F01L 1/34*** | (2006.01) |
| ***F01L 1/344*** | (2006.01) |
| ***F01L 13/00*** | (2006.01) |
| ***F01L 1/08*** | (2006.01) |
| ***F01L 1/356*** | (2006.01) |
| *F01L 1/047* | (2006.01) |

(52) U.S. Cl.
CPC ..... *F01L 1/344* (2013.01); *F01L 1/047* (2013.01); *F01L 1/08* (2013.01); *F01L 1/34413* (2013.01); *F01L 1/356* (2013.01); *F01L 13/0026* (2013.01); *F01L 2001/0471* (2013.01); *F01L 2001/0473* (2013.01)

(58) Field of Classification Search
CPC ..... F01L 1/344; F01L 1/34413; F01L 1/356; F01L 2001/0471; F01L 2001/0473
USPC ..... 123/90.16, 90.39, 90.44
See application file for complete search history.

(56) References Cited

U.S. PATENT DOCUMENTS

| | | | | |
|---|---|---|---|---|
| 9,046,012 | B2 * | 6/2015 | Yano | F01L 1/34 123/90.15 |
| 2013/0213332 | A1 | 8/2013 | Yano et al. | |

FOREIGN PATENT DOCUMENTS

| | | | |
|---|---|---|---|
| JP | H11-62531 | A | 3/1999 |
| JP | 2005-256653 | A | 9/2005 |
| JP | 2011-122546 | A | 6/2011 |
| JP | 2012-149621 | A | 8/2012 |
| JP | 2013-194555 | A | 9/2013 |
| JP | 2014-020244 | A | 2/2014 |
| WO | 2012/063536 | A1 | 5/2012 |

* cited by examiner

*Primary Examiner* — Ching Chang
(74) *Attorney, Agent, or Firm* — Andrews Kurth Kenyon LLP

(57) ABSTRACT

A variable valve device includes: a drive shaft member rotating synchronously with a crankshaft provided in an internal combustion engine; a cam shaft member including a cam lobe and rotatably provided about the drive shaft member; a drive arm portion provided in the drive shaft member and rotating together with the drive shaft member; a control sleeve provided with an eccentric hole into which the drive shaft member is inserted, and arranged to vary a position of a central axis of the eccentric hole; and a first rotary member including a first member connected to the drive arm portion and a second member connected to the cam shaft member, and rotating along an inner circumferential wall surface of the eccentric hole.

4 Claims, 30 Drawing Sheets

VARIABLE VALVE DEVICE

CROSS-REFERENCE TO RELATED APPLICATION

This is a national phase application based on the PCT International Patent Application No. PCT/JP2012/083414 filed Dec. 25, 2012, the entire contents of which are incorporated herein by reference.

TECHNICAL FIELD

The present invention is related to a variable valve device.

BACKGROUND ART

Conventionally, there is known a variable valve device for variably controlling an working angle of a cam driving an intake valve or an exhaust valve installed in an internal combustion engine. For example, Patent Document 1 describes a variable valve device for varying the working angle by using a non-constant velocity universal joint.

PRIOR ART DOCUMENT

Patent Document

[Patent Document 1] Japanese Unexamined Patent Application Publication No. 11-62531

SUMMARY OF THE INVENTION

Problems to be Solved by the Invention

In the conventional art, there is a possibility to cause a change in the valve opening/closing timing for every cylinder. In view of the above circumstances, it is an object of the present invention to provide a variable valve device capable of suppressing a change in the valve opening/closing timing.

Means for Solving the Problems

The present invention is a variable valve device including: a drive shaft member rotating synchronously with a crankshaft provided in an internal combustion engine; a cam shaft member including a cam lobe and rotatably provided about the drive shaft member; a drive arm portion provided in the drive shaft member and rotating together with the drive shaft member; a control sleeve provided with an eccentric hole into which the drive shaft member is inserted, and arranged to vary a position of a central axis of the eccentric hole; and a first rotary member including a first member connected to the drive arm portion and a second member connected to the cam shaft member, and rotating along an inner circumferential wall surface of the eccentric hole, wherein the first rotary member rotates in a state where the first member and the second member are secured to each other, a relative position between the first member and the second member about a central axis line of the drive shaft member is variable.

In the above configuration, there may be provided: a first link member connected to the rotary arm portion and the first member; and a second link member connected to the cam shaft member and the second member, wherein an angle about the central axis line between a connection point of the first member and the first link member and a connection point of the second member and the second link member may be variable.

In the above configuration, the cam shaft member, the drive arm portion, and the control sleeve may be provided for every cylinder of an internal combustion engine, a second rotary member may be provided to correspond to at least one of the cylinders, may rotate along the inner circumferential wall surface of the eccentric hole, and may be an integrated member, and the first rotary member may be provided to correspond to the cylinder other than the at least one of the cylinders among the cylinders.

In the above configuration, the control sleeve may include a first gear portion in an outer circumferential surface, there may be provide: a control shaft facing in a direction same as a direction in which the drive shaft faces; a second gear portion corresponding to at least one of the cylinders, provided in an outer circumference of the control shaft, engageable with the first gear portion, and secured to the control shaft; and a third gear portion corresponding to the cylinder other than the at least one of the cylinders among the cylinders, provided in an outer circumference of the control shaft, engageable with the first gear portion, and rotatable about a central axis line of the control shaft independently of the second gear portion.

Effects of the Invention

According to the present invention, it is possible to provide a variable valve device capable of suppressing a change in valve opening/closing timing.

BRIEF DESCRIPTION OF THE DRAWINGS

FIG. 5A-1 is a perspective view of a cam shaft member, FIG. 5A-2 is a perspective view of the cam shaft member when viewed in the direction different from FIG. 5A-1, FIG. 5B-1 is a left side view of the cam shaft member, FIG. 5B-2 is a front view of the cam shaft member, and FIG. 5B-3 is a right side view of the cam shaft member;

FIG. 6A-1 is a perspective view of a drive arm portion, FIG. 6A-2 is a perspective view of the drive arm portion when viewed in the direction different from FIG. 6A-1, FIG. 6B-1 is a left side view of the drive arm portion, FIG. 6B-2 is a front side view of the drive arm portion, and FIG. 6B-3 is a right side view of the drive arm portion;

FIG. 9A-1 is a perspective view of a first link member (second link member), FIG. 9A-2 is a perspective view of the first link member (second link member) when viewed in the direction different from FIG. 9A-1, FIG. 9B-1 is a left side view of the first link member (second link member), FIG. 9B-2 is a front view of the first link member (second link member), and FIG. 9B-3 is a right side view of the first link member (second link member);

FIG. 10A-1 is a perspective view of a control sleeve, FIG. 10A-2 is a perspective view of the control sleeve when viewed in the direction different from FIG. 10A-1, FIG. 10B-1 is a left side view of the control sleeve, FIG. 10B-2 is a front view of the control sleeve, and FIG. 10B-3 is a right side view of the control sleeve.

MODES FOR CARRYING OUT THE INVENTION

Figure 1:
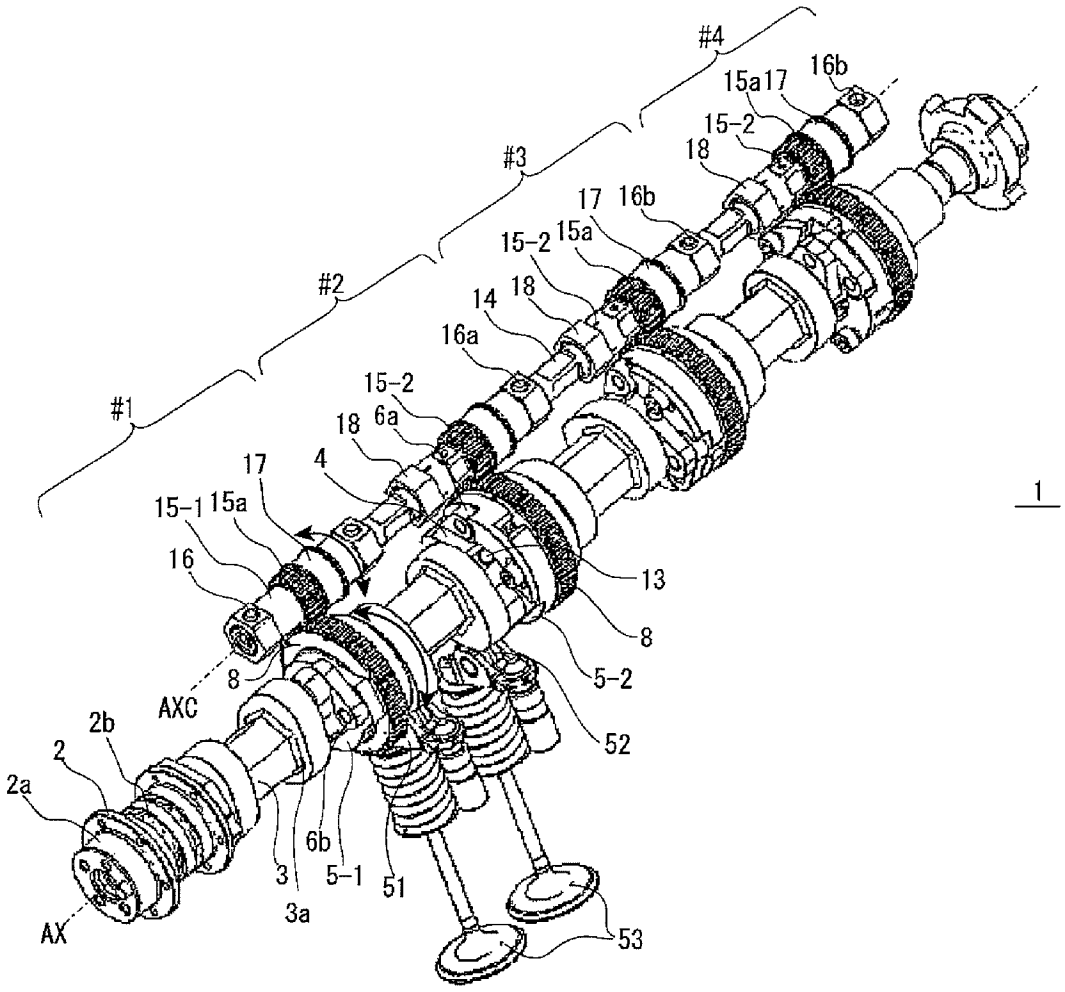
FIG. 1 is a perspective view illustrating a variable valve device according to the first embodiment.

An embodiment according to the present invention will be described with reference to the accompanying drawings. However, a dimension and a ratio of each component illustrated in the drawings may not correspond to the reality.

First Embodiment

Figure 2:
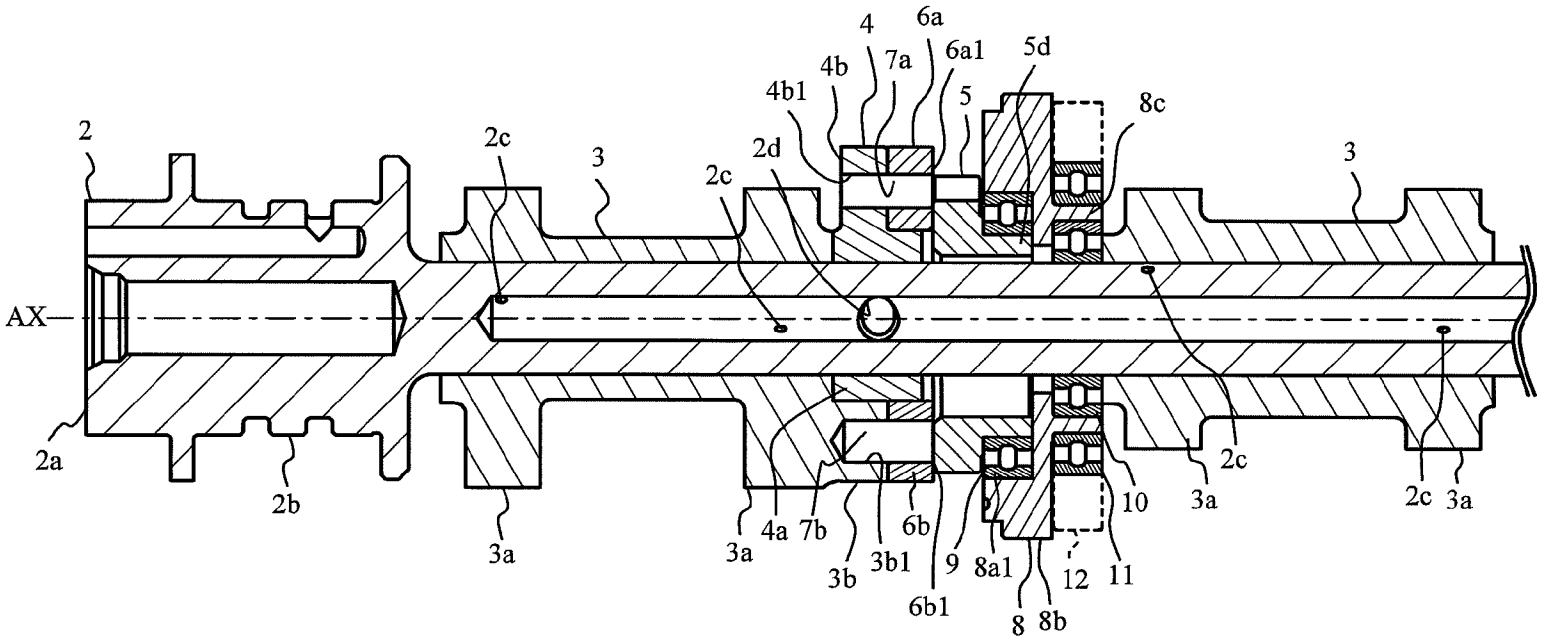
FIG. 2 is an explanatory view illustrating a partial cross section of the variable valve device.
Figure 3:
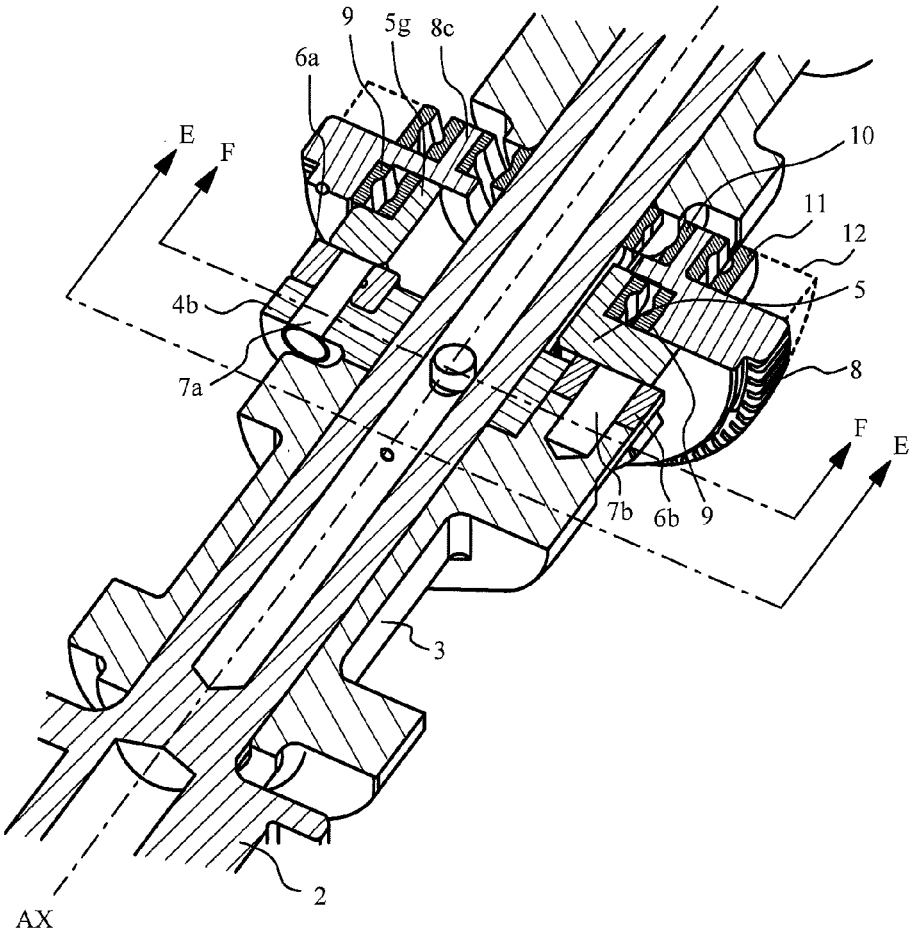
FIG. 3 is a perspective view illustrating a partially enlarged cross section of the variable valve device 1.

The first embodiment is an example of adjustment of an working angle and valve opening timing. FIG. 1 is a perspective view illustrating a variable valve device 1 according to the first embodiment. FIG. 2 is an explanatory view illustrating a partial cross section of the variable valve device 1. FIG. 3 is a perspective view illustrating a partially enlarged cross section of the variable valve device 1. The variable valve device 1 is installed in an inline four-cylinder internal combustion engine. The variable valve device 1 is used for driving intake valves 53 of the internal combustion engine, but also can be used for driving exhaust valves. In the internal combustion engine, a #1 cylinder, a #2 cylinder, a #3 cylinder, and a #4 cylinder are arranged in this order from the front side. Each cylinder is provided with the two intake valves 53.

As illustrated in FIG. 1 to FIG. 3, the variable valve device 1 is provided with a drive shaft member 2 that rotates in synchronism with a crankshaft of the internal combustion engine. The variable valve device 1 is provided with a cam shaft member 3 that is rotatably provided in the circumference of the drive shaft member 2. The cam shaft member 3 includes cam lobes 3*a*. The variable valve device 1 is provided with drive arm portions 4 which are provided in the drive shaft member 2 and which rotate together with the drive shaft member 2. The variable valve device 1 is provided with drive disks 5-1 and 5-2 (hereinafter, collectively referred to as drive disk), and control sleeves 8. The drive disk rotates along an inner circumferential wall surface 8*a*1 of an eccentric hole 8*a* provided in the control sleeve 8. One of drive disks corresponding to the cylinder #1 is represented by the drive disk 5-1 (second rotary member). The others corresponding to the cylinders #2 to #4 are represented by the drive disks 5-2 (first rotary member).

Figure 4:
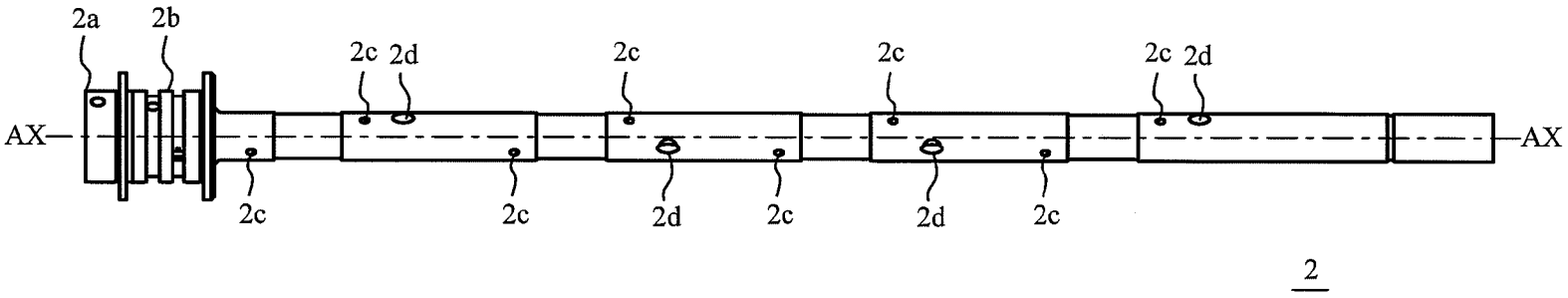
FIG. 4 is a plan view of a drive shaft member.

FIG. 4 is a plan view of the drive shaft member 2. As illustrated in FIG. 4, the drive shaft member 2 is provided at its front end portion with a VVT (Variable Valve Timing) mounting portion 2*a* and a bearing portion 2*b*. The drive shaft member 2 is a hollow rod-shaped member, and is provided with: oil supply holes 2*c* for supplying lubricating oil; and a pin hole 2*d* for securing the drive arm portion 4 to the drive shaft member 2 by using a connection pin 13 (see FIG. 1). The pin hole 2*d* penetrates through the drive shaft member 2. The pin hole 2*d* is provided so as to correspond to each of the cylinders #1 to #4. A central axis line of the drive shaft member 2 is AX.

Figures 1, 5A:
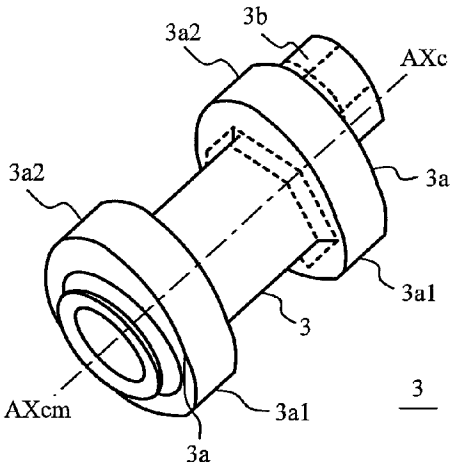
Figures 2, 5A:
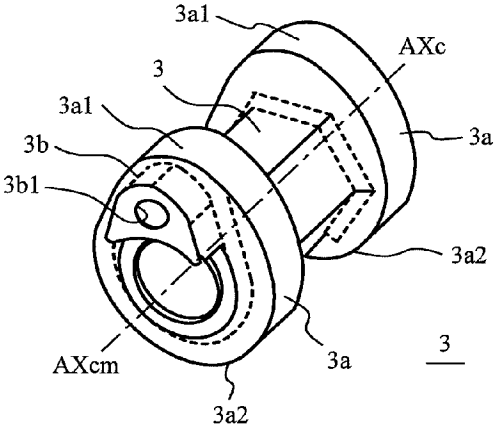
Figures 1, 5B:
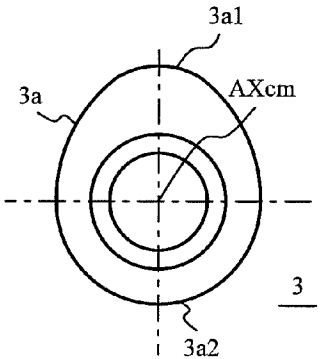
Figures 2, 5B:
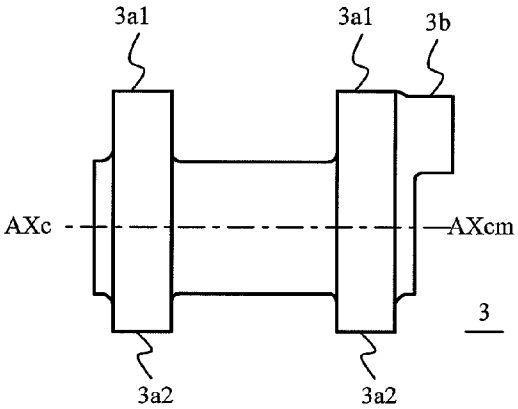
Figures 3, 5B:
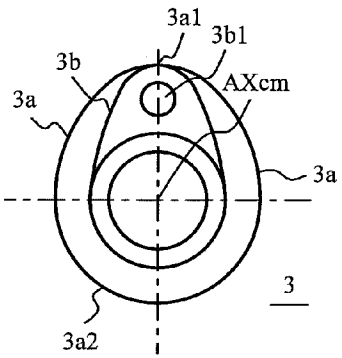

FIG. 5A-1 is a perspective view of the cam shaft member 3. FIG. 5A-2 is a perspective view of the cam shaft member 3 when viewed in the direction different from FIG. 5A-1. FIG. 5B-1 is a left side view of the cam shaft member 3. FIG. 5B-2 is a front view of the cam shaft member 3. FIG. 5B-3 is a right side view of the cam shaft member 3. As illustrated in FIG. 5A-1 to FIG. 5B-3, the cam shaft member 3 is a tube-shaped member, and is provided with the two cam lobes 3*a* corresponding to the number of the intake valves 53 provided in each cylinder. A rotational central axis line of the cam shaft member 3 is AXcm. The cam shaft member 3 is rotatably provided in the circumference of the drive shaft member 2 such that the rotational central axis line AXcm coincides with the central axis line AX of the drive shaft member 2. The cam lobe 3*a* is provided with a nose portion 3*a*1 and a base circle portion 3*a*2. One of the two cam lobes 3*a* is provided at its side surface with a pin joint portion 3*b*. This pin joint portion 3*b* is connected with an end of a second link member 6*b* as will be detailed later. The cam shaft member 3 is provided for each of the cylinders #1 to #4, and is rotatably provided in the circumference of the drive shaft member 2 as illustrated in FIG. 1 to FIG. 3. The cam lobe 3*a* comes into contact with a rocker roller 52 provided in a rocker arm 51, and causes the intake valve 53 to lift.

Figures 1, 6A:
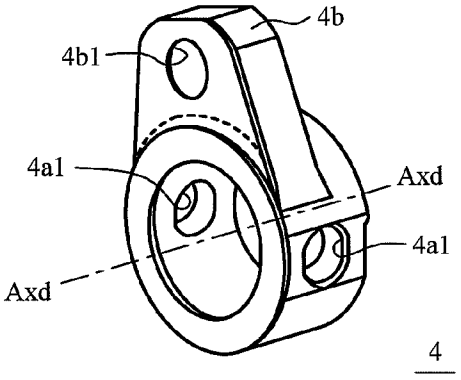
Figures 2, 6A:
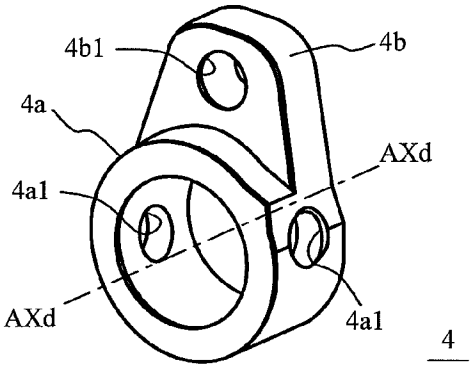
Figures 1, 6B:
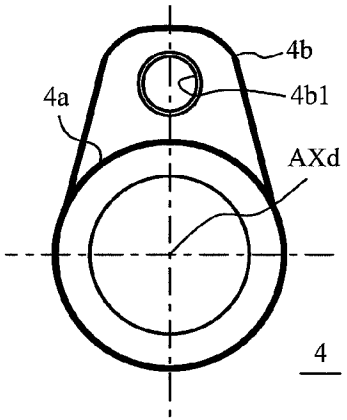
Figures 2, 6B:
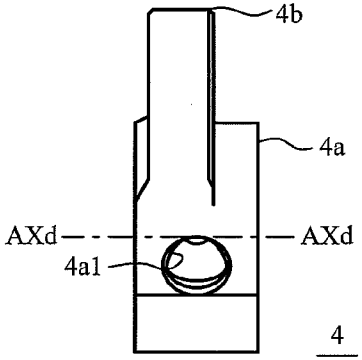
Figures 3, 6B:
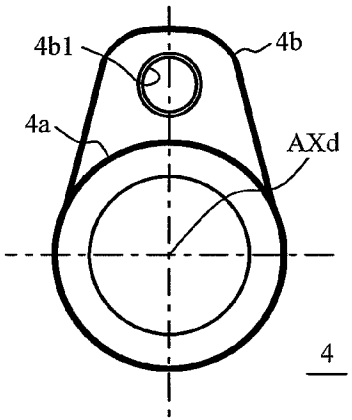

FIG. 6A-1 is a perspective view of the drive arm portion 4. FIG. 6A-2 is a perspective view of the drive arm portion 4 when viewed in the direction different from FIG. 6A-1. FIG. 6B-1 is a left side view of the drive arm portion 4. FIG. 6B-2 is a front side view of the drive arm portion 4. FIG. 6B-3 is a right side view of the drive arm portion 4. As illustrated in FIG. 6A-1 to FIG. 6B-3, the drive arm portion 4 is a cylindrical-shaped member, and is provided with a cylindrical-shaped portion 4*a* and a plate-shaped portion 4*b* serving as an arm. A rotational central axis of the drive arm portion 4, that is, the central axis line of the cylindrical-shaped portion 4*a* is AXd. The drive arm portion 4 is secured to the drive shaft member 2 such that this central axis line AXd coincides with the central axis line AX of the drive shaft member 2. The cylindrical-shaped portion 4*a* is provided with a pin hole 4*a*1 into which the connection pin 13 is inserted (see FIG. 1) in order that the drive arm portion 4 is secured to and integrated with the drive shaft member 2. The plate-shaped portion 4*b* is provided with a pin insertion hole 4*b*1 for connecting an end of a first link member 6*a* as will be described later. The drive arm portion 4 is provided for each of the cylinders #1 to #4, and is secured to the drive shaft member 2 by the connection pin 13 illustrated in FIG. 1. That is, the drive arm portion 4 is provided integrally with the drive shaft member 2 and rotates together with the drive shaft member 2. Referring to FIG. 1 to FIG. 3, the drive arm portion 4 is arranged adjacent to the cam shaft member 3. At this time, the drive arm portion 4 is attached to the drive shaft member 2 so as not to interfere with the pin joint portion 3*b* provided in the cam shaft member 3.

Figure 7:
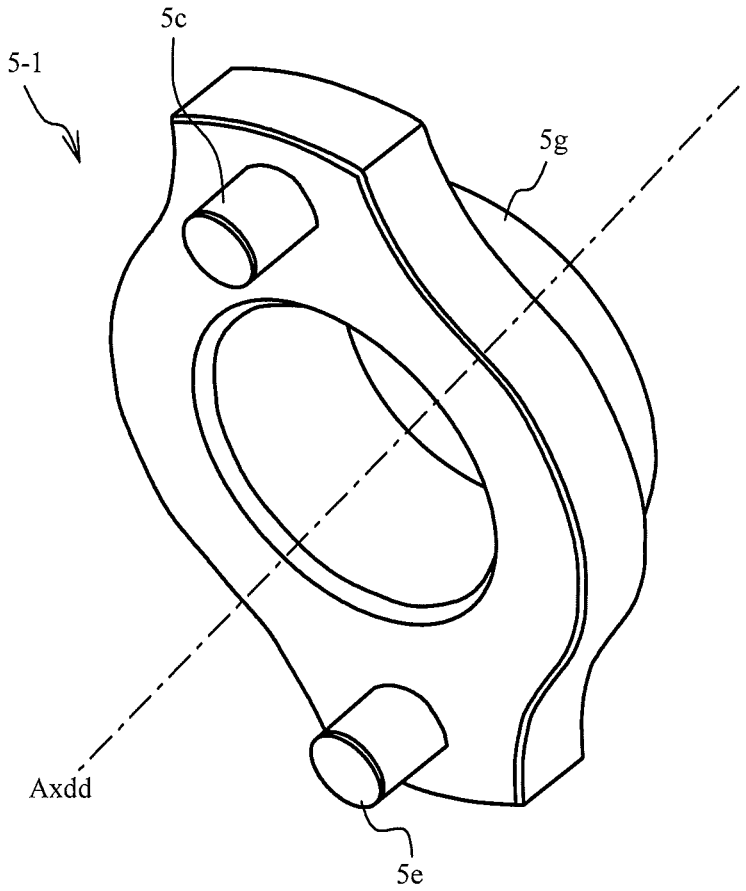
FIG. 7 is a perspective view exemplary illustrating a drive disk.

FIG. 7 is a perspective view exemplary illustrating the drive disk 5-1. As illustrated in FIG. 7, the drive disk 5-1 is provided with pins 5*c* and 5*e*, and a cylindrical-shaped portion 5*g*. The pins 5*c* and 5*e* project in the direction toward a surface of the drive disk 5-1, and the cylindrical-shaped portion 5*g* projects in the opposite direction. The drive disk 5-1 rotates along an inner circumferential wall surface 8*a*1 of the eccentric hole 8*a* provided in the control sleeve 8 which will be described later. Referring to FIG. 1 to FIG. 3, the cylindrical-shaped portion 5*g* is inserted into the eccentric hole 8*a*. The rotational axis line of the drive disk 5-1, that is, the central axis line of the cylindrical-shaped portion 5*g* is AXdd, and coincides with the central axis line AX2 of the eccentric hole 8*a* provided in the control sleeve 8 which will be described later. A first bearing 9 is interposed between the inner circumferential wall surface 8*a*1 of the eccentric hole 8*a* and the cylindrical-shaped portion 5*g*. The angle A between the pin 5*e* and the pin 5*c* (angle between pins) is, for example, 180 degrees.

Figure 8A:
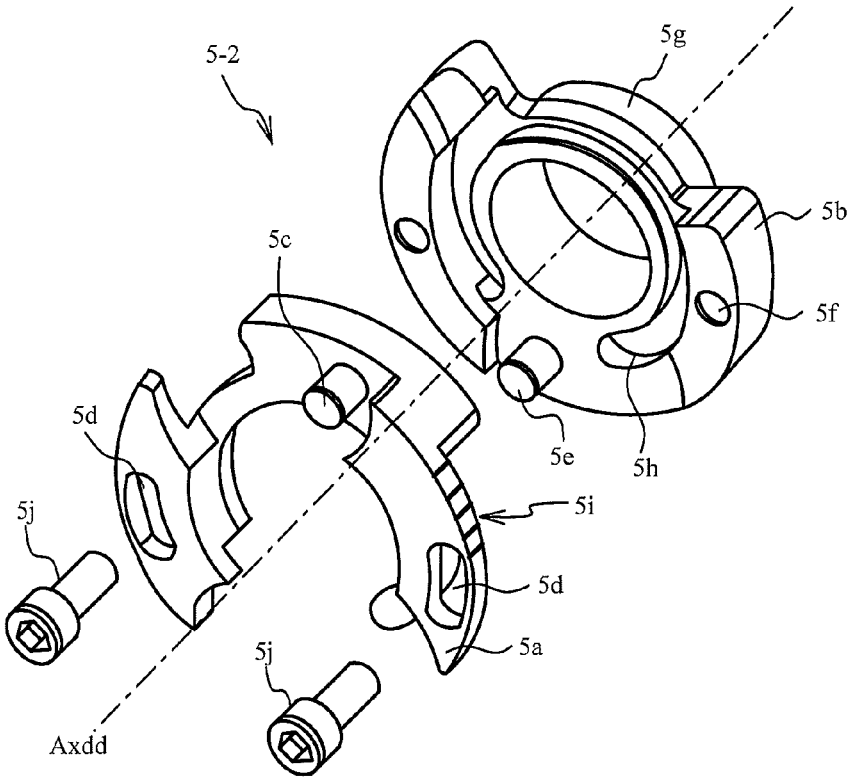
FIG. 8A is an exploded perspective view illustrating the drive disk.
Figure 8B:
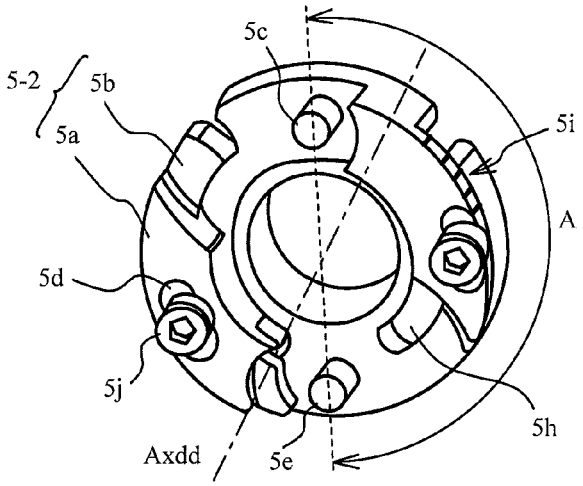
FIG. 8B is a perspective view exemplary illustrating the drive disk.

FIG. 8A is an exploded perspective view illustrating the drive disk 5-2. FIG. 8B is a perspective view exemplary illustrating the drive disk 5-2. As illustrated in FIG. 8A and FIG. 8B, the drive disk 5-2 includes a drive side disk 5*a* (first member) and a driven side disk 5*b* (second member). The drive side disk 5*a* has a pin 5*c* and grooves 5*d*. The driven side disk 5*b* has a pin 5*e*, holes 5*f*, the cylindrical-shaped portion 5*g*, and a recess portion 5*h*. The drive side disk 5*a* is attached to the driven side disk 5*b* such that the grooves 5*d* overlap the holes 5*f*. A part of the drive disk side 5*a* is fitted into the recess portion 5*h*. The drive side disk 5*a* is secured to the driven side disk 5*b* by bolts 5*j* inserted into the grooves 5*d* and the holes 5*f*. Accordingly, the drive disk 5-2 is formed. Like the drive disk 5-1, the drive disk 5-2 rotates along the inner circumferential wall surface 8*a*1 of the eccentric hole 8*a*.

In the example illustrated in FIG. 8B, A is 180 degrees. As described later, a relative position between the drive side disk 5*a* and the driven side disk 5*b* about the central axis line AX of the drive shaft member 2 is varied by loosening the bolts 5*j*. That is, the angle A between the pins is variable. A scale 5*i* is provided on the outer circumferential surface of the drive side disk 5*a*. The scale 5*i* can be used as a measure of the angle A between the pins. Since the drive disk 5-1 is an integral member, the angle A between the pins in the drive disk 5-1 is constant, for example, 180 degrees.

Figures 1, 9A:
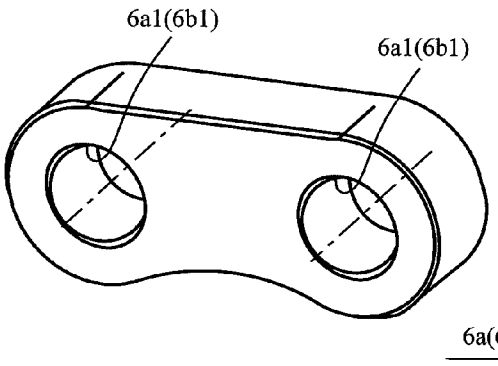
Figures 2, 9A:
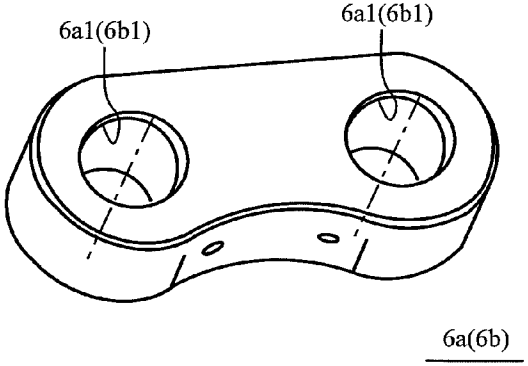
Figures 1, 9B:
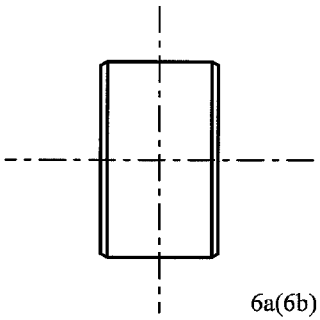
Figures 2, 9B:
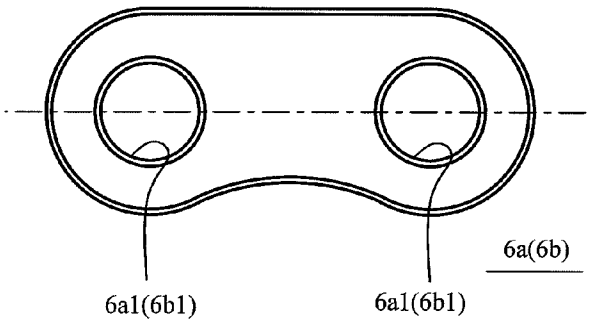
Figures 3, 9B:
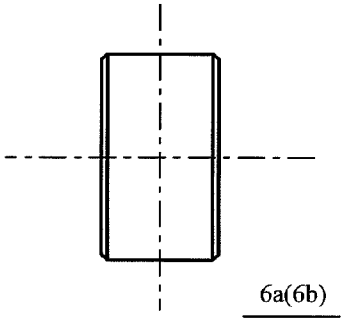

FIG. 9A-1 is a perspective view of a first link member (second link member). FIG. 9A-2 is a perspective view of the first link member (second link member) when viewed in the direction different from FIG. 9A-1. FIG. 9B-1 is a left side view of the first link member (second link member). FIG. 9B-2 is a front view of the first link member (second link member). FIG. 9B-3 is a right side view of the first link member (second link member).

As illustrated in FIG. 9A-1 to FIG. 9B-3, the first link member 6*a* is provided with two pin insertion holes 6*a*1. Likewise, the second link member 6*b* is provided with two pin insertion holes 6*b*1. The first link member 6*a* and the second link member 6*b* have the same shape. The first link member 6*a* and the second link member 6*b* are a link member for transmitting the rotation of the drive arm portion 4 to the cam shaft member 3 via the drive disk. An end side of the first link member 6*a* is connected to the drive arm portion 4 by a pin 7*a*, and the other end is connected to the drive disk by the pin 5*c*. Specifically, the pin 7*a* is inserted into the pin insertion hole 4*b*1 provided in the drive arm portion 4 and the pin insertion hole 6*a*1 provided at the end side of the first link member 6*a*, so the drive arm portion 4 and the first link member 6*a* are connected by the pin connection. The pin 5*c* is inserted into the pin insertion hole 6*a*1 provided at the other end of the first link member 6*a*, so the first link member 6*a* and the drive disk are connected by the pin connection. Accordingly, the rotation of the drive arm portion 4 is transmitted to the drive disk.

An end of the second link member 6*b* is connected to the drive disk by using the pin 5*e*, and the other end is connected to the cam shaft member 3 by using a pin 7*b*. Specifically, the pin 5*e* is inserted into the pin insertion hole 6*b*1 provided at the end of the second link member 6*b*, whereby the second link member 6*b* and the drive disk are connected by the pin connection. The pin 7*b* is inserted into the pin insertion hole 6*b*1 provided at the other end of the second link member 6*b* and into a pin insertion hole 3*b*1 of the cam shaft member 3, whereby the second link member 6*b* and the cam shaft member 3 are connected by the pin connection. Accordingly, the rotation of the drive disk is transmitted to the cam shaft member 3. In this way, the first link member 6*a* and the second link member 6*b* transmit the rotation of the drive arm portion 4 to the cam shaft member 3 via the drive disk. In the cylinders #2 to #4, the first link member 6*a* is connected to the drive side disk 5*a*, and the second link member 6*b* is connected to the driven side disk 5*b*.

Both the first link member 6*a* and the second link member 6*b* are disposed in the pins 5*e* and 5*c* side of the drive disk. The control sleeve 8, a second bearing 10, a third bearing 11, a cap 12 are disposed in the cylindrical-shaped portion 5*g* side.

Figures 1, 10A:
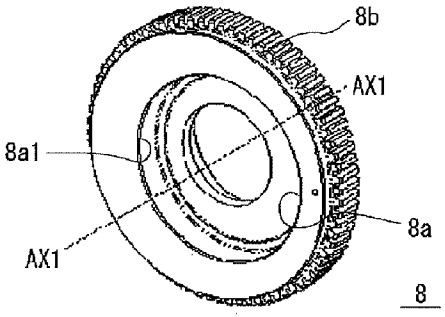
Figures 2, 10A:
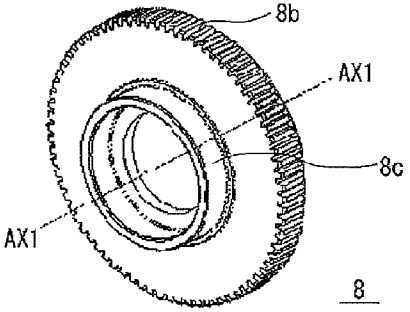
Figures 1, 10B:
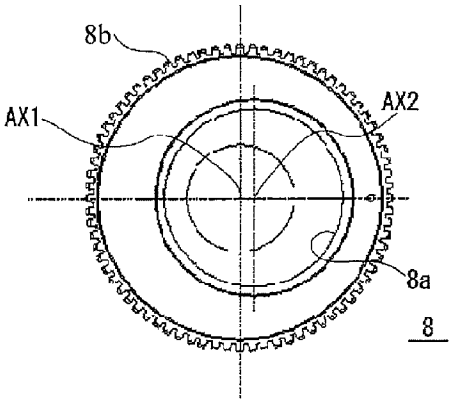
Figures 2, 10B:
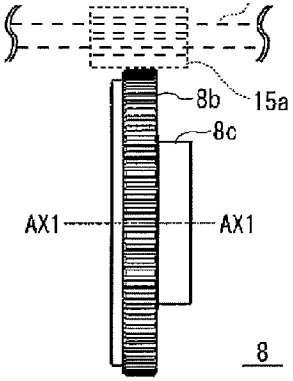
Figures 3, 10B:
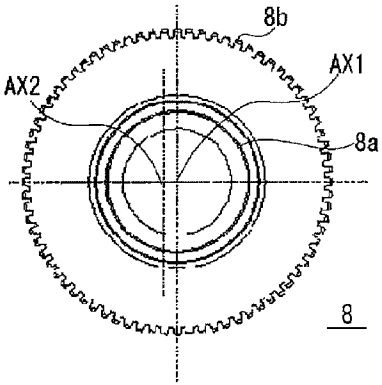

FIG. 10A-1 is a perspective view of the control sleeve 8, and FIG. 10A-2 is a perspective view of the control sleeve 8 when viewed in the direction different from FIG. 10A-1. FIG. 10B-1 is a left side view of the control sleeve 8, FIG. 10B-2 is a front view of the control sleeve 8, and FIG. 10B-3 is a right side view of the control sleeve 8.

As illustrated in FIG. 10A-1 to FIG. 10B-3, the control sleeve 8 is provided with the eccentric hole 8*a*, with a gear portion 8*b* (first gear portion) at its outer circumferential surface, and with a cylindrical-shaped portion 8*c*. The rotational central axis line AX1 of the control sleeve 8 coincides with a central axis line about an inner circumference of the cylindrical-shaped portion 8*c*. This rotational central axis line AX1 is different from the central axis line AX2 of the eccentric hole 8*a*. The drive shaft member 2 is inserted into the eccentric hole 8*a* and the cylindrical-shaped portion 8*c*. The central axis line AX of the drive shaft member 2 inserted into the eccentric hole 8*a* and the cylindrical-shaped portion 8*c* coincides with the rotation central axis line AX1 of the control sleeve 8, that is, the central axis line of the cylindrical-shaped portion 8*c*. As illustrated in FIG. 2 and FIG. 3, the cylindrical-shaped portion 5*g* of the drive disk 5 is rotatably mounted to the eccentric hole 8*a* via the first bearing 9. The interposition of the second bearing 10 between the drive shaft member 2 and the cylindrical-shaped portion 8*c* causes the drive shaft member 2 to be supported within the cylindrical-shaped portion 8*c* via the second bearing 10. The third bearing 11 is mounted on the outside of the cylindrical-shaped portion 8*c*, and the cap 12 is disposed in the outer side of the third bearing 11. Thus, both the control sleeve 8 and the drive shaft member 2 are mounted together on the internal combustion engine. The gear portion 8*b* is meshed with a gear portion 15*a* provided in an outer circumferential surface of a control shaft 14, as illustrated in FIG. 10B-2, and causes the control sleeve 8 to rotate in response to the rotation of the control shaft 14. The rotation of the control sleeve 8 varies the position of the central axis line AX2 of the eccentric hole 8*a*. This will be described in detail later.

In the first embodiment, a position of the central axis line AX2 which has been adjusted to the height of an end surface of a cam cap 55 to be described later serves as a reference position. The working angle in the reference position serves as a reference working angle. The control sleeve 8 is rotated to one side from this state, so the rotational speed of the cam shaft member 3 increases during the time the intake valve 53 is opened, and the rotational speed of the cam shaft member 3 decreases during the time the intake valve 53 is closed. The drive shaft member 2 is rotated in this state, so that the valve opening timing of the intake valve 53 is advanced and the valve closing timing is retarded, which increases the working angle. When the control sleeve 8 is rotated from the reference position to the other side, the working angle is reduced. This will be described in detail later.

As illustrated in FIG. 1 to FIG. 3, the cam shaft member 3, the drive arm portion 4, the drive disk, and the control sleeve 8 are provided for each of the cylinders #1 to #4. The cam shaft member 3 and the drive arm portion 4 are mounted on the drive shaft member 2 inserted thereinto. The drive arm portion 4 is secured to the drive shaft member 2 by using the connection pin 13. The drive disk attached with the first link member 6*a* and the second link member 6*b* in the side from which the pins 5*c* and 5*e* protrude, and the control sleeve 8 are mounted. The first bearing 9 and the second bearing 10 are mounted on the cylindrical-shaped portion 8*c* positioned in the rear end side of the control sleeve 8. The cap 12 is disposed around the second bearing 10 when the variable valve device 1 is mounted on the internal combustion engine. The combination of the first bearing 9, the second bearing 10, and the cap 12 is provided for each cylinder. That is, the variable valve device 1 is supported by four points of the internal combustion engine.

Thus, in the variable valve device 1 according to the first embodiment, the drive shaft member 2 and the control sleeve 8 can be supported by the internal combustion engine without separating the space for supporting the drive shaft member 2 by the internal combustion engine from the space for supporting the control sleeve 8 by the internal combustion engine. That is, the variable valve device 1 has a good mounting property to the internal combustion engine. The combination of the first bearing 9, the second bearing 10, and the cap 12 is provided for every cylinder. That is, the variable valve device 1 is supported by four points of the internal combustion engine. This can ensure the rigidity of the valve system. Further, since the cam shaft member 3 is not supported, the target valve lift can be achieved without swinging the rotational axis line of the cam lobe 3*a*, which enables a good valve lift waveform.

Figure 11A:
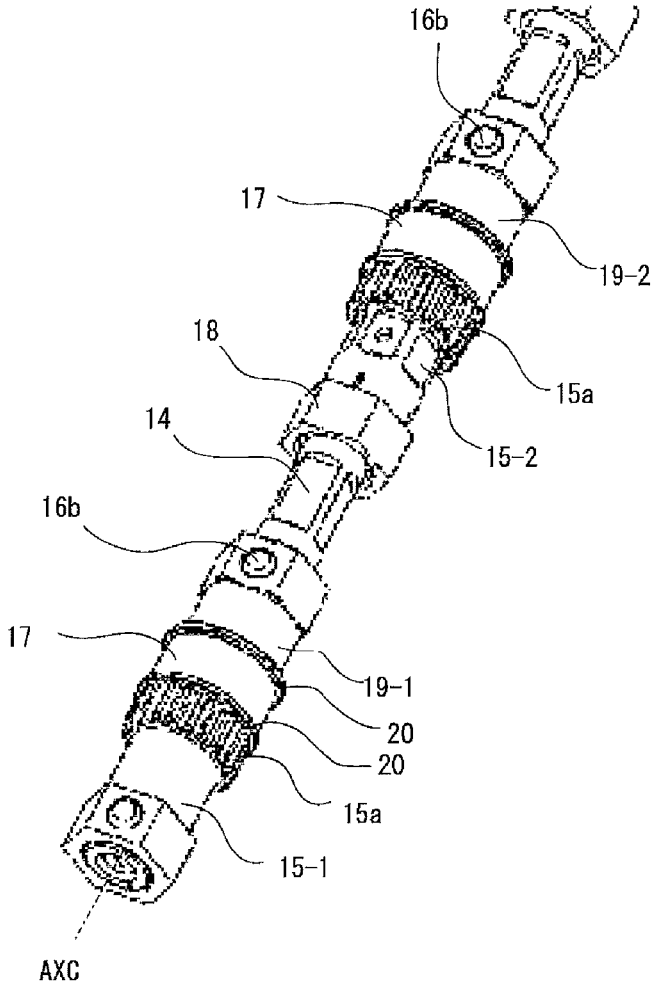
FIG. 11A is an enlarged perspective view of a control shaft.
Figure 11B:
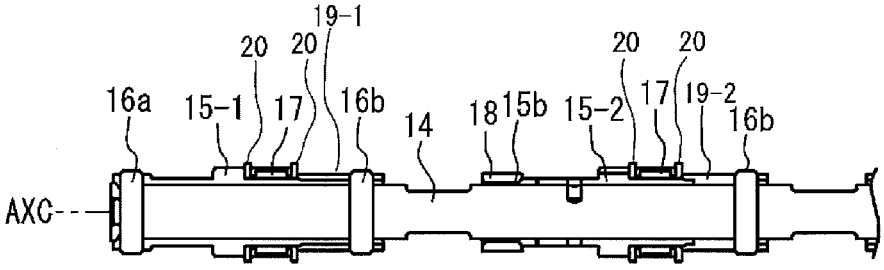
FIG. 11B is a sectional view illustrating the control shaft.

FIG. 11A is an enlarged perspective view of the control shaft 14. FIG. 11B is a sectional view illustrating the control shaft 14. As illustrated in FIG. 11A, the control shaft 14 is provided close to the drive shaft member 2. The central axis line AXC of the control shaft 14 faces in the direction same as the direction in which the central axis line AX of the drive shaft member 2 faces.

As illustrated in FIG. 11A and FIG. 11B, the control shaft 14 is provided at its outer circumference with pinions corresponding to respective cylinders. One of the pinions corresponding to the cylinder #1 is a pinion 15-1. The pinions corresponding to the cylinders #2 to #4 are pinions 15-2. The gear portions 15*a* are formed on the outer circumferential surfaces of the pinions 15-1 and 15-2. The gear portion 15*a* engages the gear portion 8*b* of the control sleeve 8. The pinion 15-1 is secured to the control shaft 14 by a pin 16*b* penetrating through the pinion 15-1 and the control shaft 14. The gear portion 15*a* of the pinion 15-1 (second gear portion) is secured to the control shaft 14. The pinion 15-1 is inserted into a needle bearing 17, a washer 20, and a bush 19-1, and the bush 19-1 is secured to the control shaft 14 by the pin 16*b*. The pinion 15-2 is secured to the control shaft 14 by the needle bearing 17, a nut 18, and a bush nut 19-2. The pinion 15-2 is inserted into the needle bearing 17 and the washer 20. The bush nut 19-2 is secured to the control shaft 14 by the pin 16*b*. The nut 18 tightens a screw portion 15*b* of the pinion 15-2. The pinion 15-2 is rotatable by loosening the nut 18. That is, the gear portion 15*a* of the pinion 15-2 (third gear portion) is rotatable about the central axis line AXC.

Figure 12:
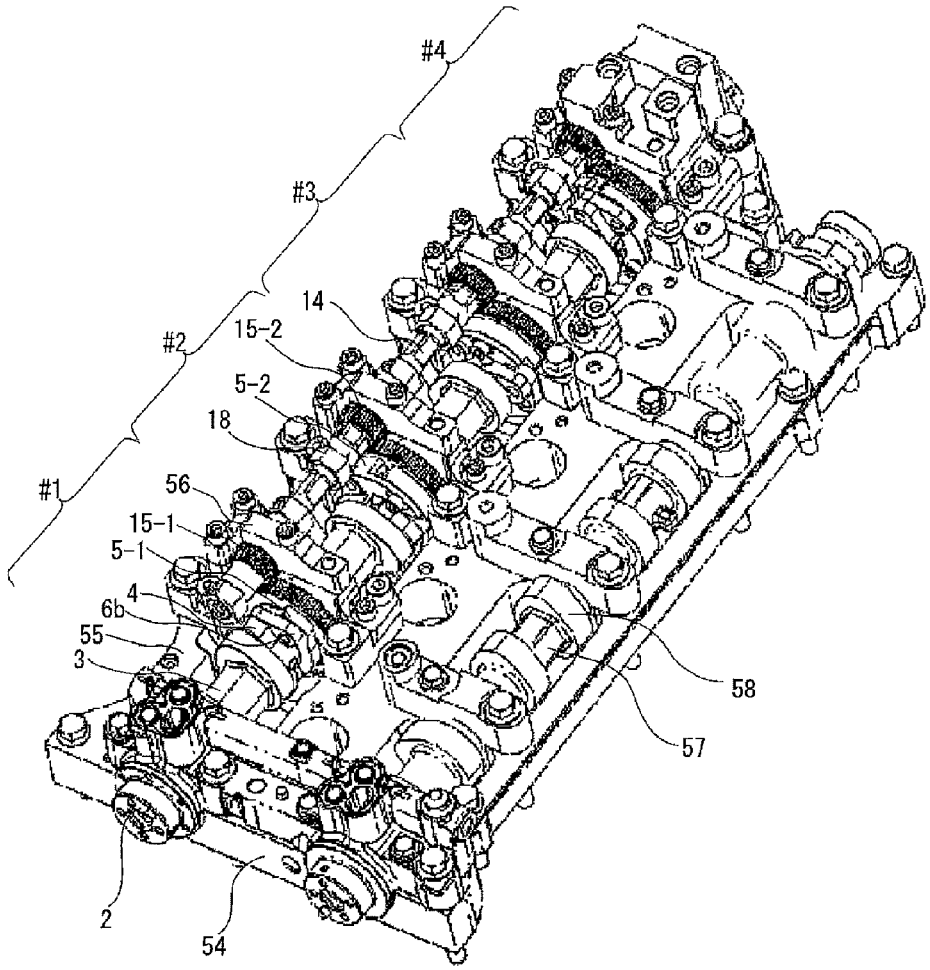
FIG. 12 is a perspective view exemplary illustrating a state where the variable valve device is mounted on a cam housing.

FIG. 12 is a perspective view illustrating a state where the variable valve device 1 is mounted on a cam housing 54. As illustrated in FIG. 12, the drive shaft member 2 and the control shaft 14 are mounted to the cam housing 54. The drive shaft member 2 is secured to the cam housing 54 by the cam cap 55, and the control shaft 14 is secured to the cam housing 54 by a control shaft cap 56. Also, a drive shaft member 57 is mounted to the cam housing 54. A cam piece 58 provided on the drive shaft member 57 opens and closes an exhaust valve not illustrated.

Figure 13:
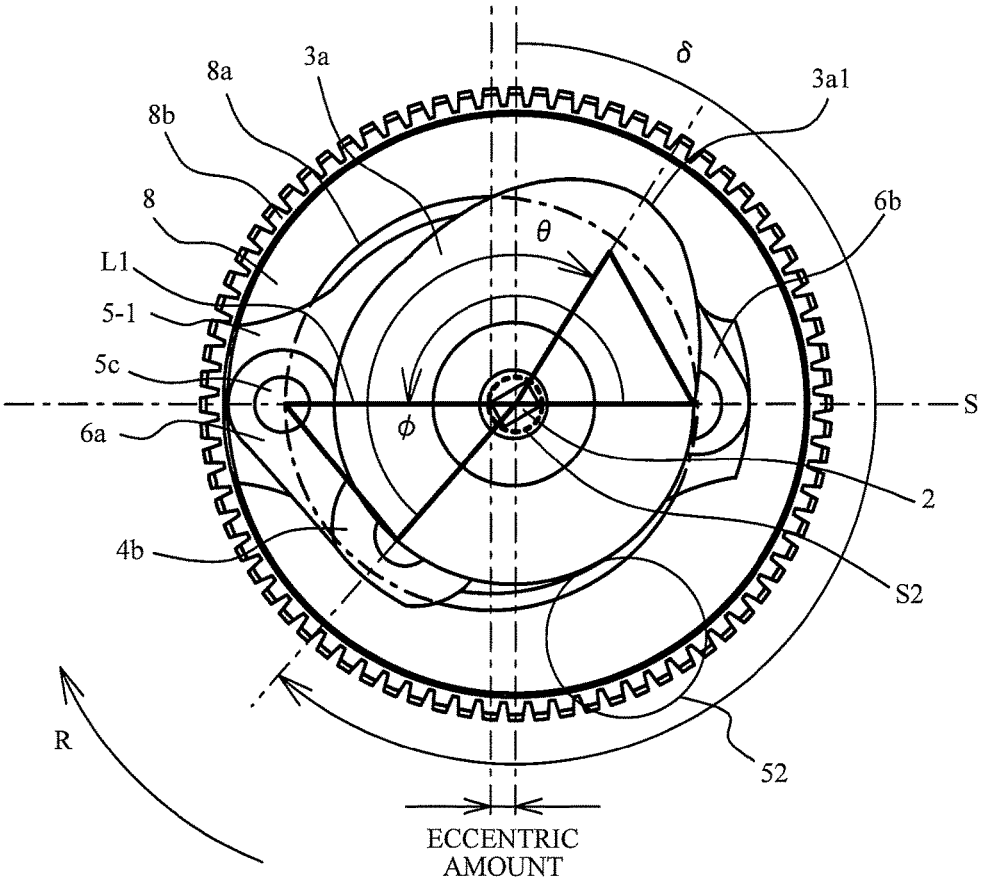
FIG. 13 is a sectional view exemplary illustrating the variable valve device.

Next, the operation of the variable valve device 1 will be described. FIG. 13 is a sectional view exemplary illustrating the variable valve device 1, and illustrates a portion corresponding to the cylinder #1. This corresponds to a cross section taken long line E-E of FIG. 3. As indicated by an arrow R in FIG. 13, the drive shaft member 2 rotates clockwise.

In FIG. 13, the eccentric hole 8*a* is offset to the left relative to the central axis line AX of the drive shaft member 2. The eccentric angle $\phi$ is an angle between an end surface S of the cam cap 55 and a straight line L1, and $\theta=180°$ is satisfied in FIG. 12. The straight line L1 is a straight line connecting the central axis line AX of the drive shaft member 2 and the central axis of the eccentric hole 8*a* of the control sleeve 8. The angle $\theta$ is a rotational angle of the cam lobe 3*a* relative to the drive shaft member 2. The rotational angle $\delta$ is a rotational angle of the drive shaft member 2 on the basis of the direction perpendicular to the end surface of the cam cap 55 (vertical direction in FIG. 13). Additionally, the central axis line AX coincides with the rotational central axis line AX1 of the control sleeve 8. As will be described later, varying the direction of the eccentricity of the eccentric holes 8*a*, that is, varying the eccentric angle $\phi$ varies the angle $\theta$. The variation in the angle $\theta$ varies the rotational speed of the cam lobe 3*a*. A circle S2 indicated by a dotted line in FIG. 13 represents the locus of the center of the eccentric hole 8*a*.

A description will be given of the operation in case of $\phi=180°$. FIG. 14A to FIG. 14D are sectional views exemplary illustrating the operation of the variable valve device 1, and illustrate a cross section taken along line F-F of FIG. 3.

Figure 14A:
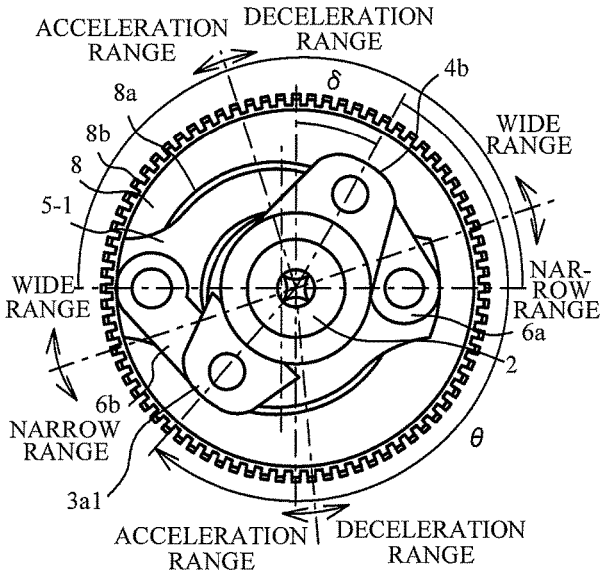
FIG. 14A to FIG. 14D are sectional views exemplary illustrating an operation of the variable valve device.
Figure 14B:
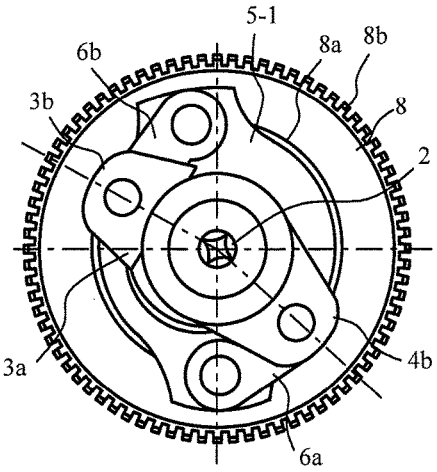
Figure 14C:
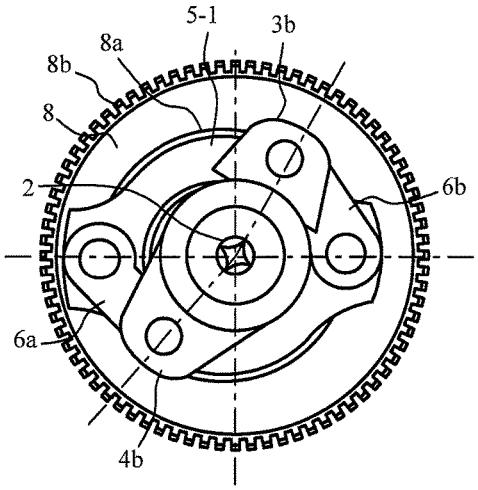
Figure 14D:
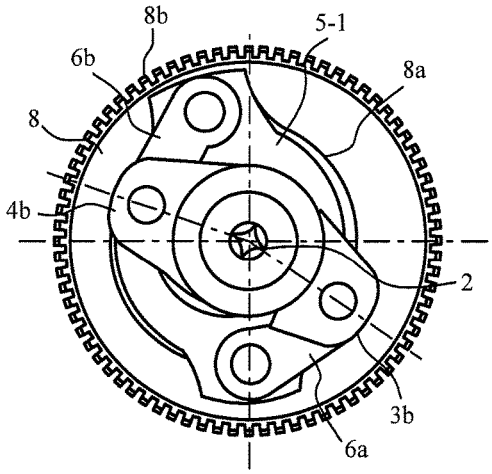

A description will be given of acceleration ranges and deceleration ranges illustrated in FIG. 14A to FIG. 14D. As illustrated in FIG. 14A and FIG. 14B, when the drive arm portion 4 is positioned within the deceleration range, the rotational speed of the cam lobe 3*a* is lower than that of the drive shaft member 2. As illustrated in FIG. 14C and FIG. 14D, when the drive arm portion 4 is positioned in the acceleration range, the rotational speed of the cam lobe 3*a* is higher than that of the drive shaft member 2. Broad ranges and narrow ranges will be described. As illustrated in FIG. 14A and FIG. 14D, when the drive arm portion 4 is positioned within the wide range, the angle $\theta$ is greater than 180 degrees. As illustrated in FIG. 14B and FIG. 14C, when the drive arm portion 4 is positioned in the narrow range, the angle $\theta$ is smaller than 180 degrees. In other words, in the wide range, the cam lobe 3*a* is in a position to be advanced relative to the drive arm portion 4. In the narrow range, the cam lobe 3*a* is in a position to be retarded relative to the drive arm portion 4.

Figure 15A:
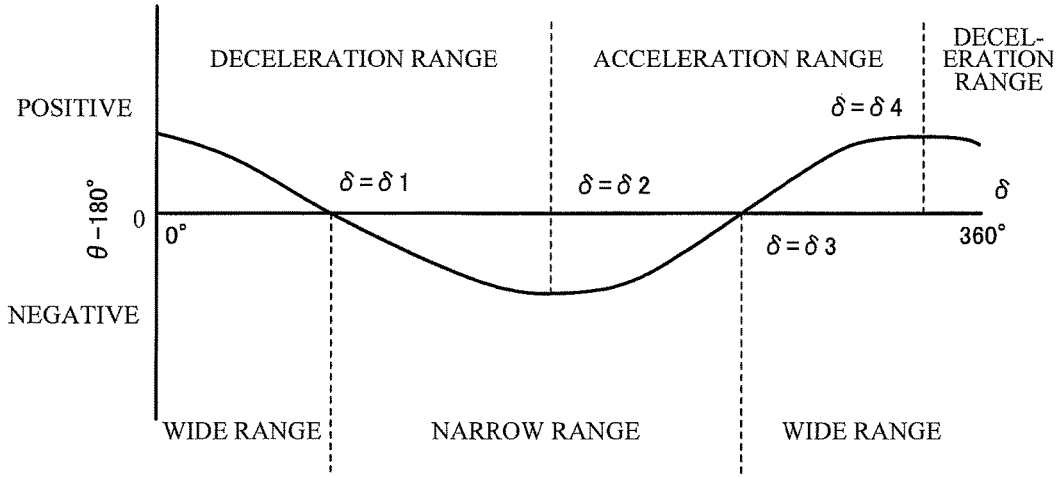
FIG. 15A is a schematic view exemplary illustrating a relationship between a rotational angle δ and an angle θ.
Figure 15B:
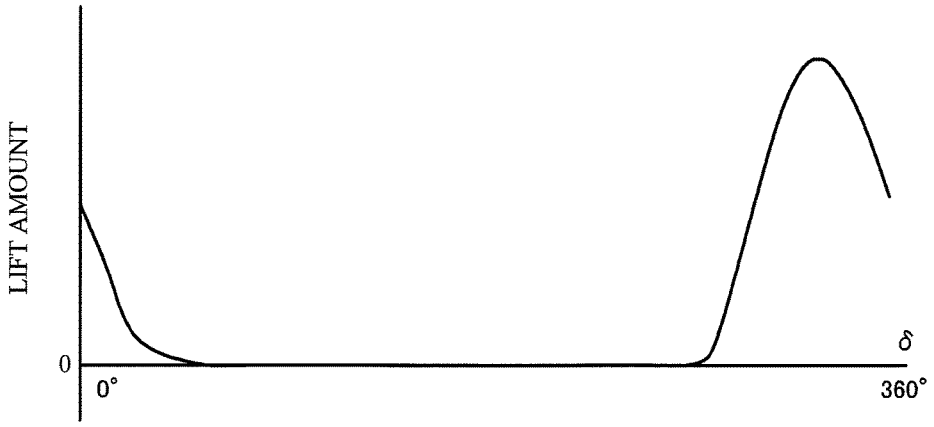
FIG. 15B is a schematic view exemplary illustrating a lift amount.

FIG. 15A is a schematic view exemplary illustrating a relationship between the rotational angle $\delta$ and the angle $\theta$. A vertical axis represents the rotational angle $\delta$, and a horizontal axis represents the angle $\theta$. FIG. 15B is a schematic view exemplary illustrating a lift amount. A horizontal axis represents the rotational angle $\delta$, and a horizontal axis represents the lift amount of the intake valve 53.

When the value of the vertical axis illustrated in FIG. 15A is zero, that is, when $\theta=180°$ is satisfied, the speed of the cam lobe 3*a* is the same as that of the drive arm portion 4. In case of $\theta-180°$, that is, in case of $\theta>180°$, the cam lobe 3*a* is advanced from the drive arm portion 4. In case of $\theta-180°<0$, that is, in case of $\theta<180°$, the cam lobe 3*a* is retarded from the drive arm portion 4. In case of $\delta=0$, the drive arm portion 4 is positioned in the wide range and the deceleration range. That is, the angle $\theta$ is greater than 180 degrees, and the cam lobe 3*a* is decelerating. $\theta$ becomes smaller as the rotational angle $\delta$ becomes greater. In case of $\delta=\delta1$, the drive arm portion 4 enters the narrow range. The angle $\theta$ is smaller than 180 degrees. In case of $\delta=\delta2$, the drive arm portion 4 enters the deceleration range, and the cam lobe 3*a* is shifted from the deceleration to the acceleration. In case of $\delta=\delta3$, the drive arm portion 4 enters the wide range, and the angle $\theta$ is greater than 180 degrees. In case of $\delta=\delta4$, the drive arm portion 4 enters the deceleration range, and the cam lobe 3*a* starts decelerating.

When the rocker roller 52 is positioned as illustrated in FIG. 13, the intake valve 53 is lifted in case of the rotational angle $\delta=0°$, as illustrated in FIG. 15B. The lift amount decreases and reaches zero as the rotational angle $\delta$ increases. Namely, the intake valve 53 is closed. At this time, the drive arm portion 4 is positioned in the wide range and the deceleration range. The drive arm portion 4 enters the acceleration range in accordance with the increase in the rotational angle $\delta$, and the lift amount starts increasing just after the drive arm portion 4 also enters the wide range. Namely, the intake valve 53 is opened. While the intake valve 53 is opened, the drive arm portion 4 enters the deceleration range.

Figure 16A:
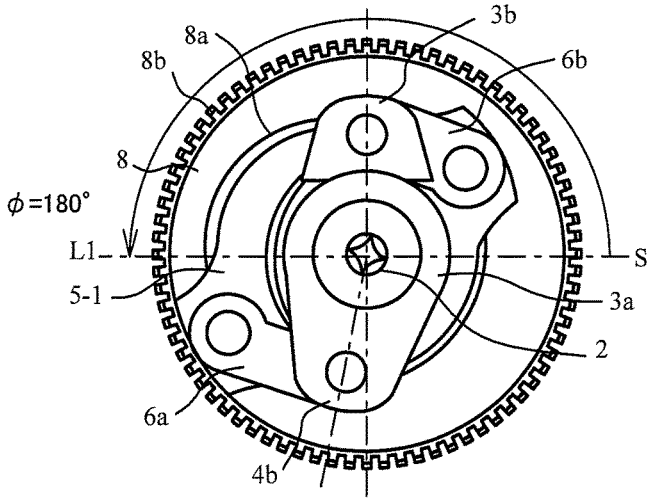
FIG. 16A is a schematic view exemplary illustrating the operation of the variable valve device in case of $\phi=180°$.
Figure 16B:
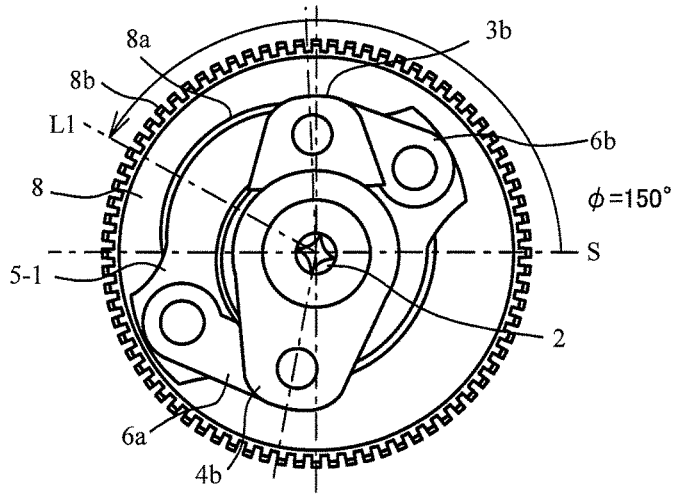
FIG. 16B is a schematic view exemplary illustrating the operation of the variable valve device in case of $\phi=150°$.
Figure 16C:
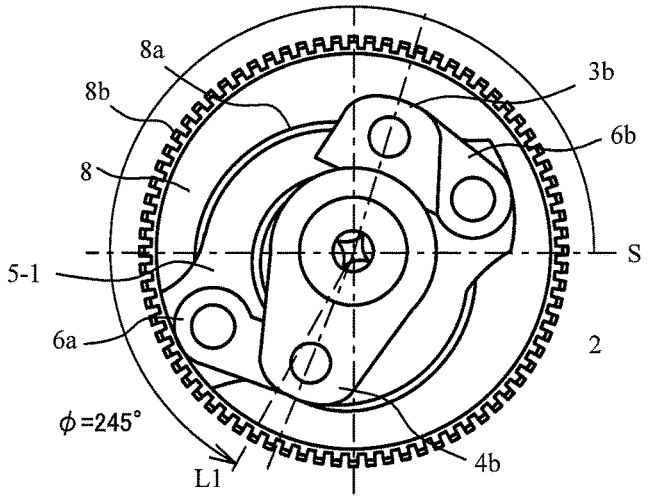
FIG. 16C is a schematic view exemplary illustrating the operation of the variable valve device in case of $\phi=245'$.

Next, an example of varying the angle $\phi$ will be described. FIG. 16A is a schematic view exemplary illustrating the operation of the variable valve device 1 in case of $\phi=180°$. FIG. 16B is a schematic view exemplary illustrating the operation of the variable valve device 1 in case of $\phi=150°$. FIG. 16C is a schematic view exemplary illustrating the operation of the variable valve device 1 in case of $\phi=245°$.

The control sleeve 8 is rotated clockwise by 30 degrees from the state of $\phi=180°$ illustrated in FIG. 16A. Thus, the state is brought into the state of $\phi=150°$ illustrated in FIG. 16B. The control sleeve 8 is rotated counterclockwise by 65 degrees from the state illustrated in FIG. 16A. The state is brought into the state of $\phi=245°$ illustrated in FIG. 16C. As will be described below, varies, whereby the valve opening/closing timing and the working angle vary.

Figure 17A:
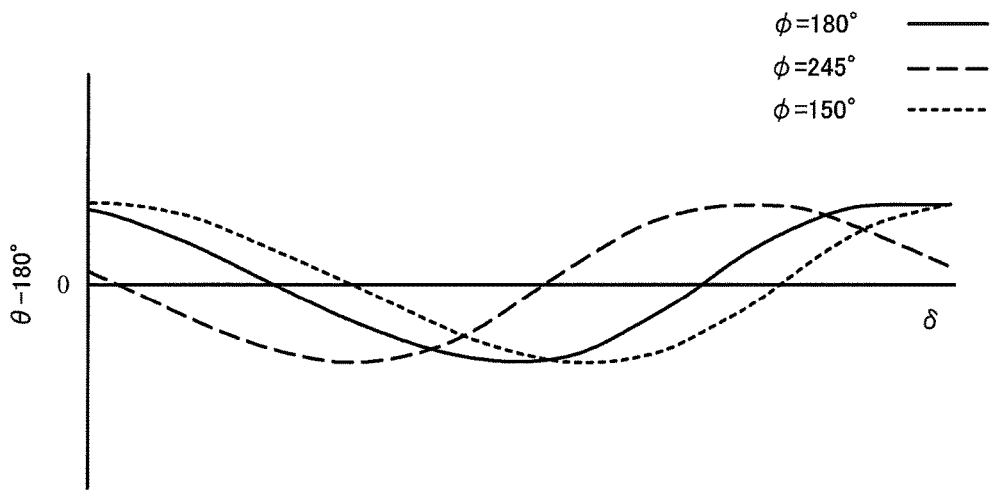
FIG. 17A is a schematic view exemplary illustrating a relationship between the rotational angle δ and the angle θ.
Figure 17B:
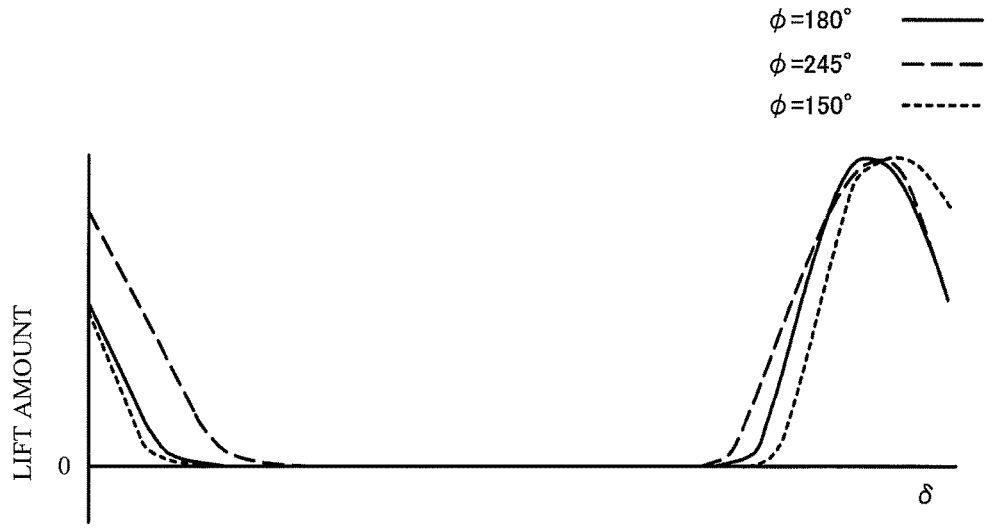
FIG. 17B is a schematic view exemplary illustrating the lift amount.

FIG. 17A is a schematic view exemplary illustrating a relationship between the rotational angle $\delta$ and the angle $\theta$. FIG. 17B is a schematic view exemplary illustrating the lift amount. In FIG. 17A and FIG. 17B, a solid line, a dashed line, and a dotted line indicate examples of $\phi=180°$, $\phi=245°$, and $\phi=150°$, respectively.

As illustrated in FIG. 17A and FIG. 17B, in the example of $\phi=245°$, in the acceleration range and the wide range, the intake valve 53 starts being opened, when $\theta$ is greater than $\theta$ in a case of $\phi=180°$. In the deceleration range and the narrow range, the intake valve 53 is closed, when $\theta$ is smaller than $\theta$ in case of $\phi=180°$. That is, in the example of $\phi=245°$, as compared with the example of $\phi=180°$, the intake valve 53 is opened early and closed late. For this reason, the working angle increases. In the example of $\phi=150°$, in the acceleration range and the narrow range, the intake valve 53 starts being opened, when $\theta$ is smaller than $\theta$ in case of $\phi=180°$. In the deceleration range and the wide range, it is closed when $\theta$ is greater than $\theta$ in case of $\phi=180°$. That is, in the example of $\phi=150°$, as compared with the example of $\phi=180°$, the intake valve 53 is opened late and closed early. For this reason, the working angle decreases. Accordingly, the eccentric angle $\phi$ can vary the valve opening/closing timing and the working angle.

As illustrated in FIG. 1 and FIG. 12, the internal combustion engine is provided with the cylinders #1 to #4. For example, component tolerances might change the valve opening/closing timing (working angle) in each of the cylinders #1 to #4. This might cause a change in an intake air amount and in a residual gas amount in the cylinder. This might result in making it difficult to ensure appropriate combustion, which might cause deterioration in fuel consumption and exhaust, a reduction in output, deterioration in drivability, damage to components of the internal combustion engine, or the like.

Figure 18A:
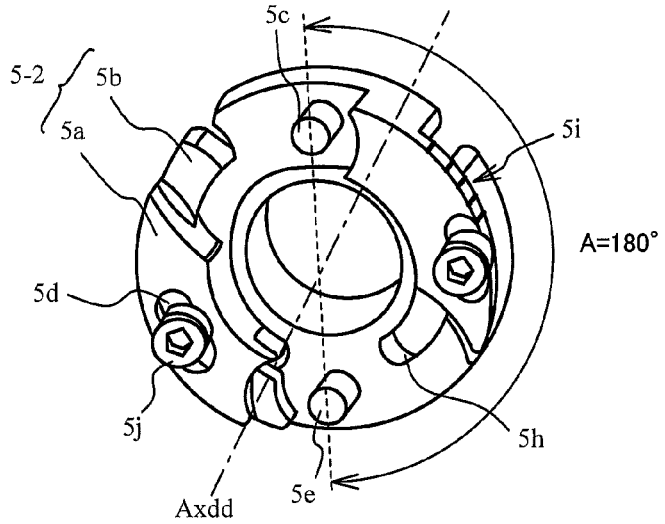
FIG. 18A to FIG. 18C are perspective views exemplary illustrating adjustment of an angle A between pins in the drive disk.
Figure 18B:
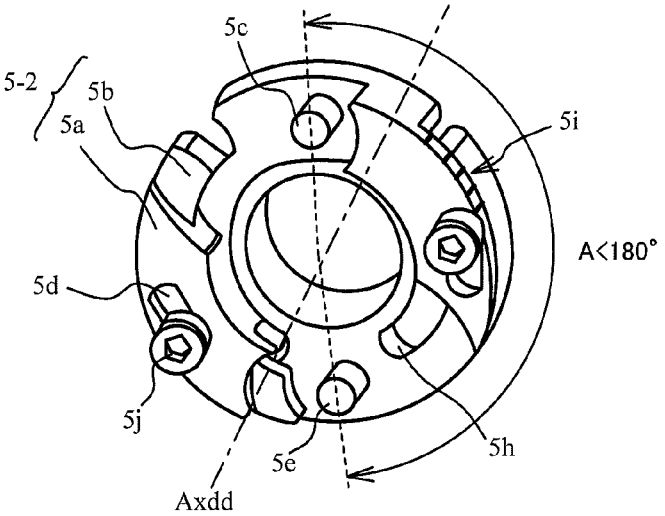
Figure 18C:
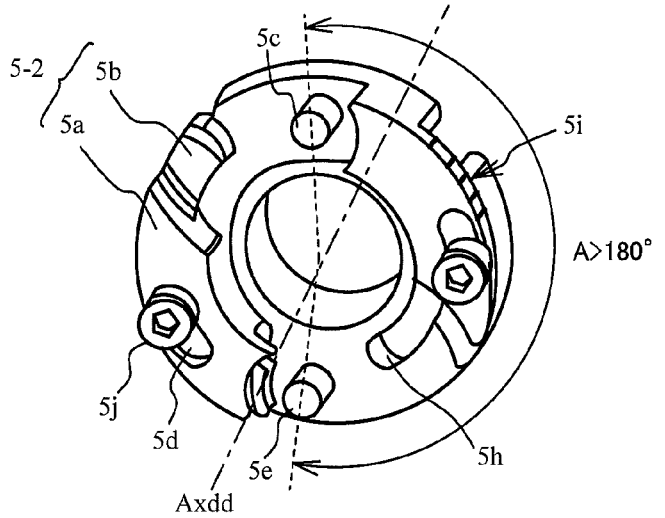

FIG. 18A to FIG. 18C are perspective views exemplary illustrating adjustment of an angle A between pins in the drive disk 5-2. In the example of FIG. 18A, the angle between pins: A=180° is satisfied. The drive side disk 5*a* or the driven side disk 5*b* is rotated by loosening the bolts 5*j*, so that the angle A between the pins is varied. In the example of FIG. 18B, A=175° is satisfied. In the example of FIG. 18C, A=185° is satisfied.

Figure 19:
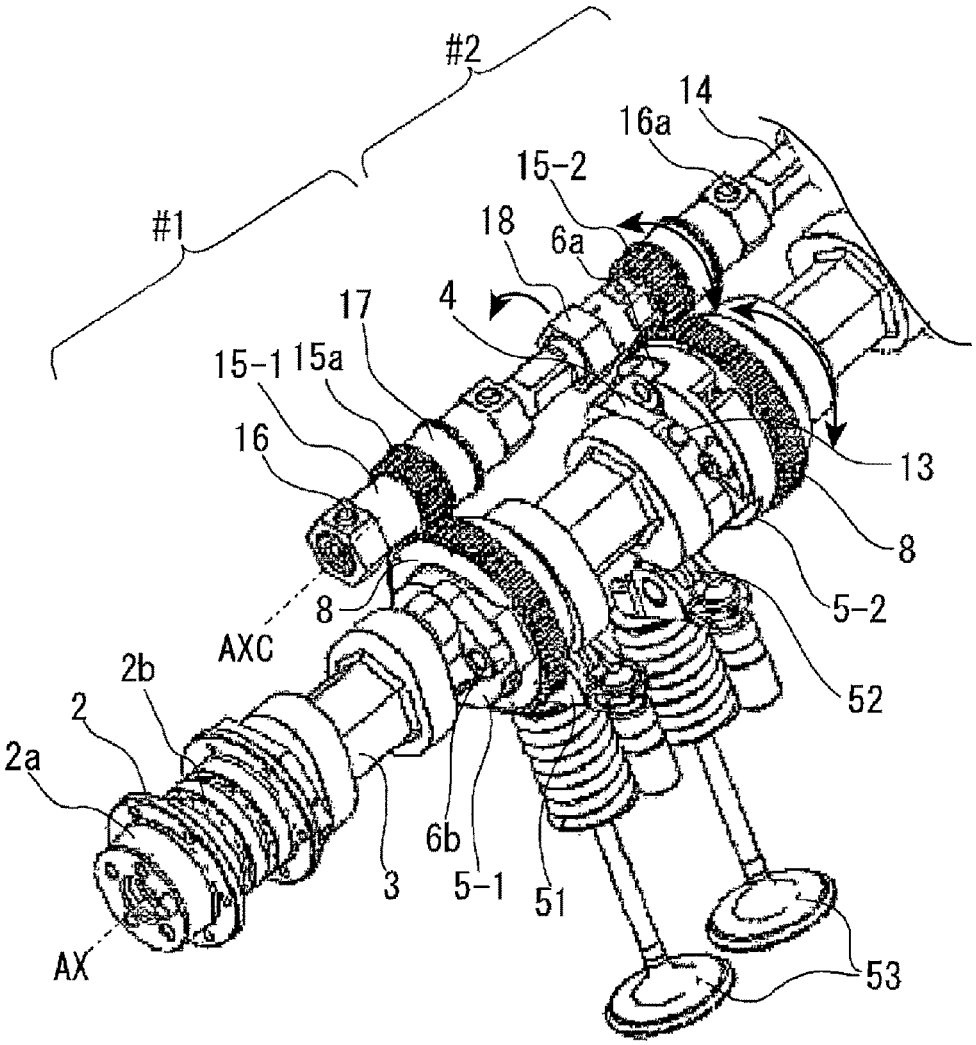
FIG. 19 is a perspective view exemplary illustrating adjustment of an eccentric angle ϕ.

FIG. 19 is a perspective view illustrating the adjustment of the eccentric angle ϕ. As indicated by an arrow in illustrated FIG. 19, loosening the nut 18 allows the pinion 15-2 to rotate. Rotating the pinion 15-2 varies the meshing of the gear portion 15*a* with the gear portion 8*b* of the control sleeve 8. This varies the eccentric angle ϕ of the eccentric hole 8*a*.

Figure 20A:
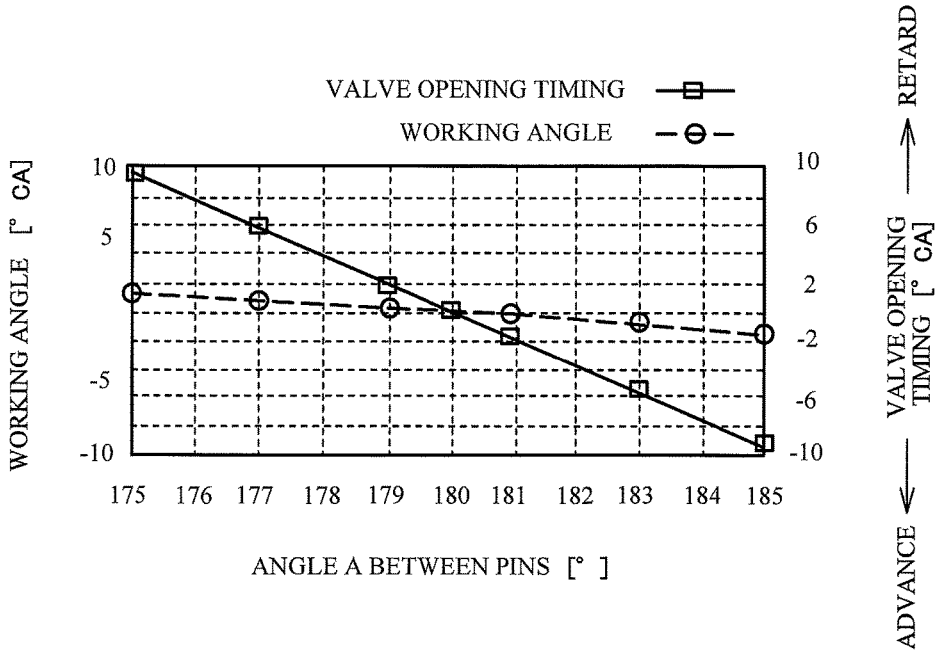
FIG. 20A is a graph exemplary illustrating a relationship among the angle A between the pins, a valve opening timing, and a working angle.

FIG. 20A is a graph exemplary illustrating a relationship among the angle A between the pins, the valve opening timing, and the working angle. The horizontal axis indicates the angle A between the pins, and the vertical axis in the right side and the dashed line indicate the working angle. The vertical axis in the left side and the solid line indicate the valve opening timing. When A=180° is satisfied, the working angle and the valve opening time serve as references (=0). As illustrated in FIG. 20A, when the angle A between the pins is less than 180 degrees, the valve opening time is shifted to the retard side (decelerated) and the working angle increases. The valve opening timing is shifted to the advance side (accelerated) and the working angle decreases as the angle A between the pins increases. However, the working angle slightly varies, but the valve opening timing drastically varies. For example, in case of A=175° to 185°, the working angle is about two degrees or minus two degrees CA, and the valve opening timing is about ten degrees to minus ten degrees CA. The valve opening/closing timing varies with the valve opening timing.

Figure 20B:
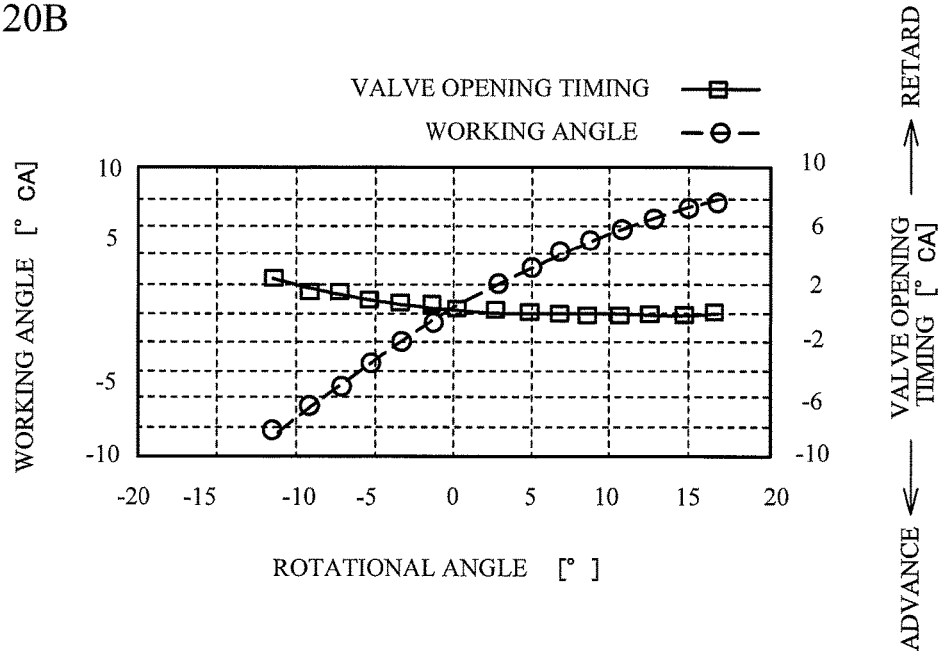
FIG. 20B is a graph exemplary illustrating a relationship among the rotational angle, the valve opening timing, and the working angle.

FIG. 20B is a graph exemplary illustrating a relationship among the rotational angle of the control sleeve 8, the valve opening timing, and the working angle. The horizontal axis represents the rotational angle of the control sleeve 8. Rotating the control sleeve 8 varies the eccentric angle ϕ. When the control sleeve 8 is not rotated (rotational angle=0°), the valve opening timing and working angle serves references (=0). The rotational angle is negative when the control sleeve 8 is rotated counterclockwise, and the rotational angle is positive, when it is rotated clockwise. As illustrated in FIG. 20B, when the rotational angle is negative, the working angle decreases and the valve opening timing is retarded. When the rotational angel is positive, the working angle increases and the valve opening timing is advanced. The valve opening timing slightly varies, but the working angle drastically varies. The valve opening timing is about two degrees to minus one degree CA, and the working angle is about minus nine degrees to nine degrees CA. The valve opening/closing timing varies with the working angle.

As described above, varying the angle A between the pins in the drive disk 5-2 can adjust the valve opening timing. Rotating the pinion 15-2 can vary the position of the eccentric holes 8*a* and adjust the working angle. The adjustment of the working angle can adjust the valve closing timing. This suppresses a change in the valve opening timing among the cylinders. In the following, a description will be given of the adjustment of the valve opening timing and the working angle.

The drive disk 5-1 corresponding to the cylinder #1 is used as a reference of the valve opening/closing timing. Since the drive disk 5-1 is an integral member, the variation in the angle A between the pins illustrated in FIG. 18A to FIG. 18C is not performed. The pinion 15-1 corresponding to the cylinder #1 is used as a reference of the working angle (valve closing timing). Since the pinion 15-1 is secured to the control shaft 14, its rotation is not performed by the method as illustrated in FIG. 19A. The valve opening/closing timing and the working angle (valve closing timing) in the cylinders #2 to #4 are approached to the valve opening/closing timing and the working angle in the cylinder #1.

Figure 21A:
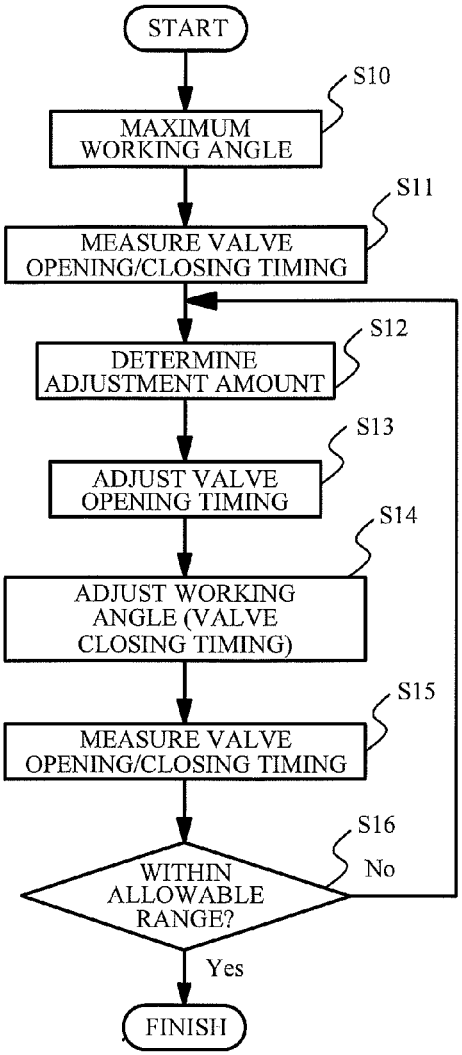
FIG. 21A is a flowchart exemplary illustrating a process of the adjustment.

FIG. 21A is a flowchart exemplary illustrating a process of the adjustment. First, the working angles of all intake valves 53 are set to the maximum working angles (step S10). The valve opening/closing timing in the cylinders #1 to #4 are measured (step S11). This is because the valve opening/closing timing is drastically changed in the maximum working angle. A valve opening timing adjustment amount and a working angle (valve closing timing) adjustment amount are determined (step S12). The valve opening timing adjustment amount is an adjustment amount of the valve opening timing to set the valve opening timing in the cylinders #2 to #4 to an allowable value as compared with the valve opening timing in the cylinder #1 serving as a reference. The working angle adjustment amount is an adjustment amount of the working angle to set the working angles (valve closing timings) in the cylinders #2 to #4 to allowable values as compared to the working angle (valve closing timing) in the cylinder #1 serving as a reference.

The valve opening timing is adjusted (step S13). The working angle (valve closing timing) is adjusted (step S14). The valve opening/closing timing is measured (step S15), and it is determined whether or not the valve opening/closing timing is within the allowable range (step S16). When No is determined, steps S12 to S15 are performed again. If Yes is determined, the work is finished.

Figure 21B:
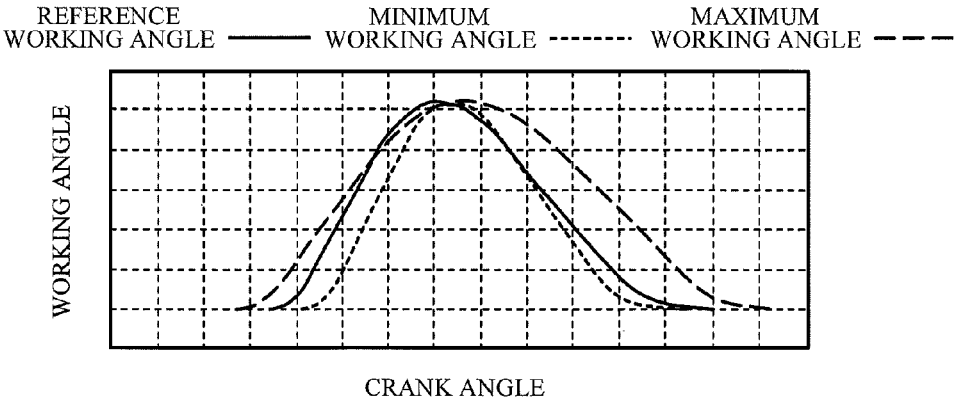
FIG. 21B is a schematic view exemplary illustrating the working angle.

FIG. 21B is a schematic view exemplary illustrating the working angle. The horizontal axis represents the crank angle, and the vertical axis represents the working angle. A solid line represents the reference working angle (for example ϕ=180°), a dashed line represents the maximum working angle (for example ϕ=245°), a dotted line represents the minimum working angle (for example ϕ=150°). There is a change in the valve opening/closing timing among the cylinders #2 to #4 between the maximum working angle and the minimum working angle. First, the working angles are set to the maximum working angles within these angles (step S10 in FIG. 21A).

Figure 22A:
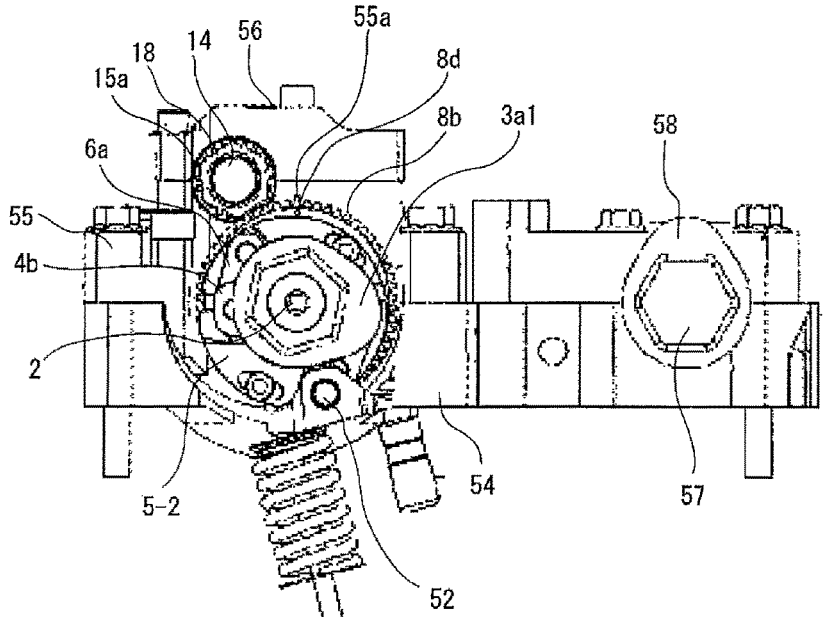
FIG. 22A and FIG. 22B are sectional views exemplary illustrating measurement of the valve opening timing.
Figure 22B:
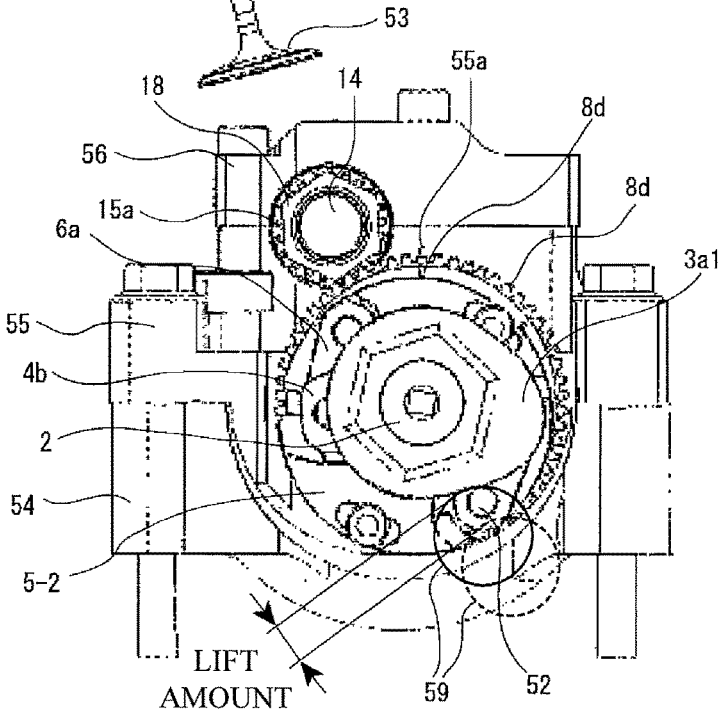

FIG. 22A and FIG. 22B are sectional views exemplary illustrating measurement of the valve opening timing. As illustrated in FIG. 22A, a mark 55*a* is provided in the cam cap 55. The mark 55*a* indicates the position of the control sleeve 8 (for example ϕ=245° to achieve the maximum working angle. The control sleeve 8 is rotated such that a mark 8*d* provided in the control sleeve 8 faces the mark 55*a*. Therefore, the working angle is maximized. Thereafter, the drive shaft member 2 is rotated, so the intake valve 53 is opened and closed. This enables to measure the valve opening/closing timing (step S11 in FIG. 21(*a*)). As illustrated in FIG. 22B, instead of the intake valve 53, a lifter 59 for inspection may be used for measuring the valve opening/closing timing.

Figure 23A:
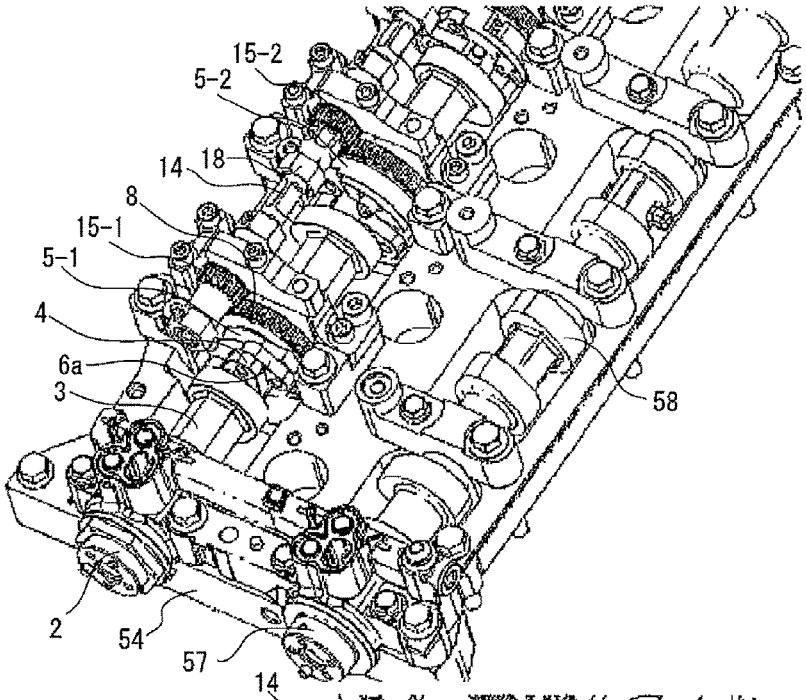
FIG. 23A and FIG. 23B are perspective views exemplary illustrating the adjustment of the angle A between the pins.
Figure 23B:
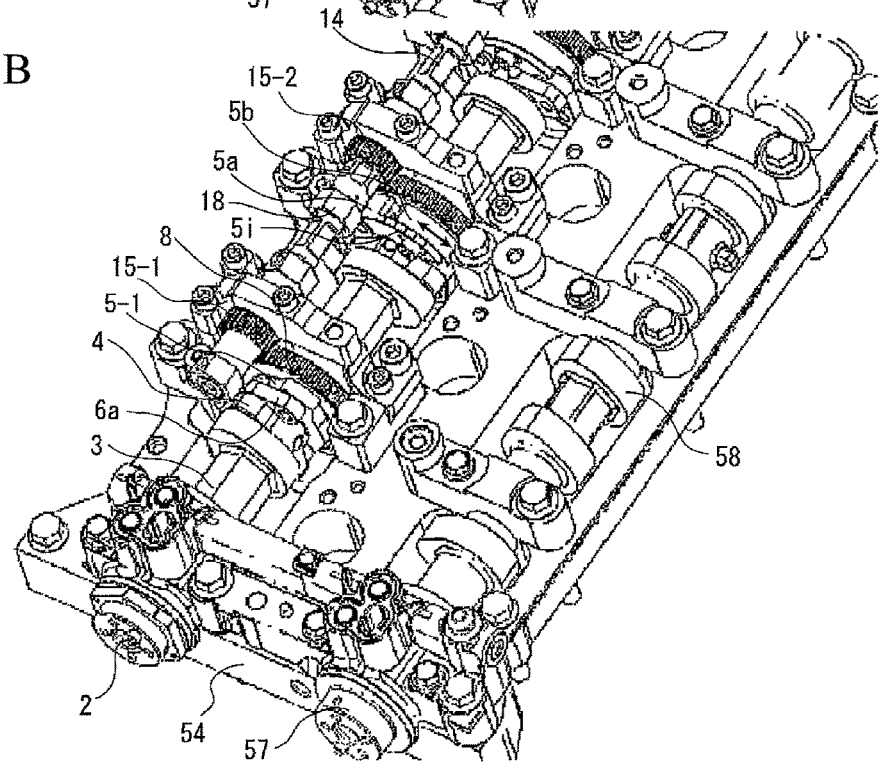

FIG. 23A and FIG. 23B are perspective views exemplary illustrating the adjustment of the angle A between the pins. The drive shaft member 2 and the control shaft 14 illustrated in FIG. 23A are secured by, for example, a jig. Accordingly, the drive arm portion 4, the first link member 6*a*, and the control sleeve 8 are secured. Therefore, the drive side disk 5*a* connected to the drive arm portion 4 does not move. One of the bolts 5*j* is loosened, the securement of the drive shaft member 2 is temporarily released and rotated, and the drive shaft member 2 is secured again. Then, the other bolt 5*j* is loosened to bring the driven side disk 5*b* into the movable state. As indicated by arrows in FIG. 23B, for example, the driven side disk 5*b* is rotated by hand or a jig. This adjusts the angle A between the pins to adjust the valve opening/closing timing within a desired range. In addition, the scale 5*i* is provided in the outer circumferential surface of the drive side disk 5*a*. The scale 5*i* can be used as a reference of the adjustment of the angle A between the pins. The driven side disk 5*b* may be rotated by rotating the cam shaft member 3. A shim or the like may be sandwiched between the drive side disk 5*a* and the driven side disk 5*b*.

Figure 24:
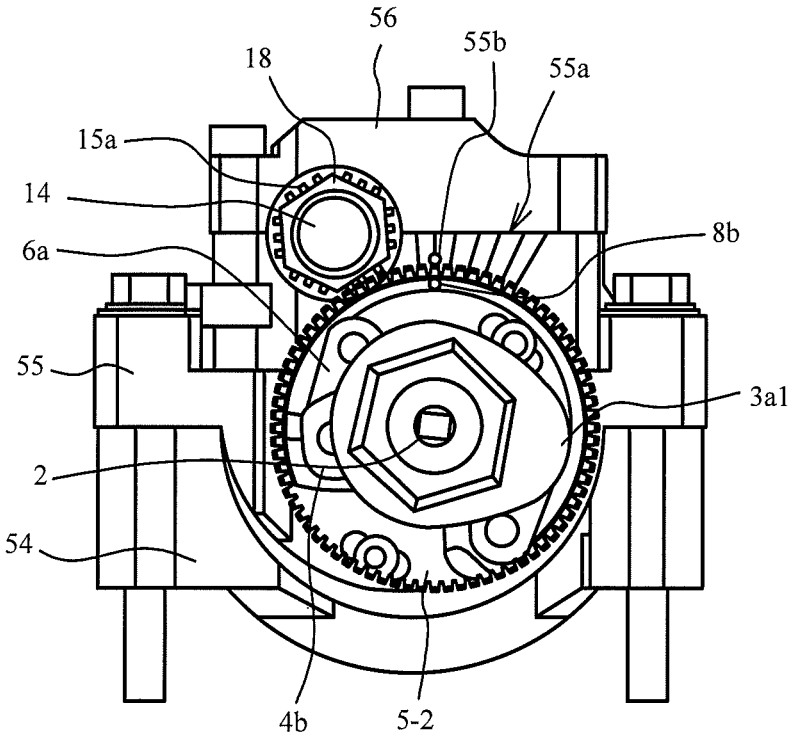
FIG. 24 is a sectional view exemplary illustrating adjustment of a position of a gear.

FIG. 24 is a sectional view exemplary illustrating the adjustment of the position of the gear. As illustrated in FIG. 24, a scale 55*b* is provided in the cam cap 55. One division of the scale 55*b* corresponds to, for example, the working angle one degree CA. The control sleeve 8 is rotated by rotating the pinion 15-2. The working angle (the valve closing timing) is set to a desired magnitude by use of the scale 55*b*.

According to the first embodiment, the drive side disk 5*a* and the driven side disk 5*b* are rotatable independently of each other. Therefore, the valve opening timing can be set to a desired magnitude by adjusting the angle A between the pins. The angle A between the pins in the drive disk 5-2 can be adjusted based on the drive disk 5-1 of the integrated member. It is thus possible to suppress a change in the valve opening timing among the cylinders. The rotation of the gear portion 15*a* of the pinion 15-2 can adjust the working angle (valve closing timing). The pinion 15-1 is rotated based on the pinion 15-1 secured to the control shaft 14. It is thus possible to suppress a change in the working angle (valve closing timing) among the cylinders. The adjustment of the valve opening timing and the working angle (valve closing timing) can suppress a change in the valve opening/closing timing.

The drive disk 5-2 and the pinion 15-2 may be provided for every cylinder. One of the drive disks 5-2 can be used as a reference of the valve opening timing, and one of the pinions 15-2 can be used as a reference of the working angle (valve closing timing). The drive disk 5-1 and the pinion 15-1 may be provided for the cylinders other than the cylinder #1. The drive disk 5-1 and the pinion 15-1 may be provided to correspond to two or more cylinders. That is, the drive disk 5-1 and the pinion 15-1 have only to be provided to correspond to at least one of the cylinders. The four-cylinder internal combustion engine has been described as an example, but the first embodiment is applicable to other internal combustion engines such as an eight-cylinder internal combustion engine other than the four-cylinder internal combustion engine.

In any cases where the working angle is large or small or where the valve opening/closing timing is advanced or retarded, the adjustment is possible. First, a description will be given of an example in which the valve opening timing is retarded, the working angle is small, and the valve closing timing is advanced, as compared with the references.

For example, the cylinder #1 serving as a reference has the following values.

valve opening timing: BTDC (Before Top Dead Center: before top dead center) 5° CA
working angle: 325° CA
valve closing timing: ABDC (After Bottom Dead Center: after bottom dead center) 140° CA The cylinder to be adjusted has the following values.

valve opening timing: BTDC 1° CA
working angle: 317° CA
valve closing timing: ABDC 136° CA As illustrated in FIG. 18C, an increase in the angle A between the pins by 2.2 degrees advances the valve opening timing and the valve closing timing to match the references (step S13 in FIG. 21(*a*)). Then, the working angle decreases by one degree CA. Rotating the pinion 15-2 by 47 degrees counterclockwise in FIG. 24 rotates the control sleeve 8 clockwise by 17 degrees. Thus, the working angle is set to 325 degrees CA as the reference (step S14 in FIG. 21A). With an increase in the working angle by eight degrees CA, the valve closing timing is retarded by 4 degrees CA. Additionally, there is little change in the valve timing caused by the rotation of the control sleeve 8. The working angle and the valve opening/closing timing within the allowable ranges have only to be obtained by the above adjustment (step S16 in FIG. 21A). Each allowable range of the valve opening timing and the valve closing timing may be, for example, the reference plus or minus 2 degrees CA.

Next, a description will be given of an example in which the valve opening timing is advanced, the working angle is large, and the valve closing timing is retarded, as compared with the references. The references are the same as the above. The cylinder to be adjusted has the following values.

valve opening timing: BTDC 9° CA
working angle: 333° CA
valve closing timing: ABDC 144° CA As illustrated in FIG. 18B, a reduction in the angle A between the pins by one degree retards the valve opening timing by two degrees CA. Then, the working angle increases by 0.5 degrees CA. Rotating the pinion 15-2 by 30 degrees clockwise in FIG. 24 rotates the control sleeve 8 counterclockwise by 11 degrees. Thus, the working angle is set to 325 degrees CA as the reference. Rotating the control sleeve 8 retards the valve opening timing and the valve closing timing by two degrees CA. The valve opening timing is advanced by two degrees CA, the valve opening timing is advanced by two degrees CA with a reduction in the working angle by eight degrees CA, the valve closing timing is advanced by eight degrees CA and retarded by two degrees, so they are close to the references. The working angle and the valve opening/closing timing within the allowable ranges have only to be obtained by the above adjustment.

Figure 25:
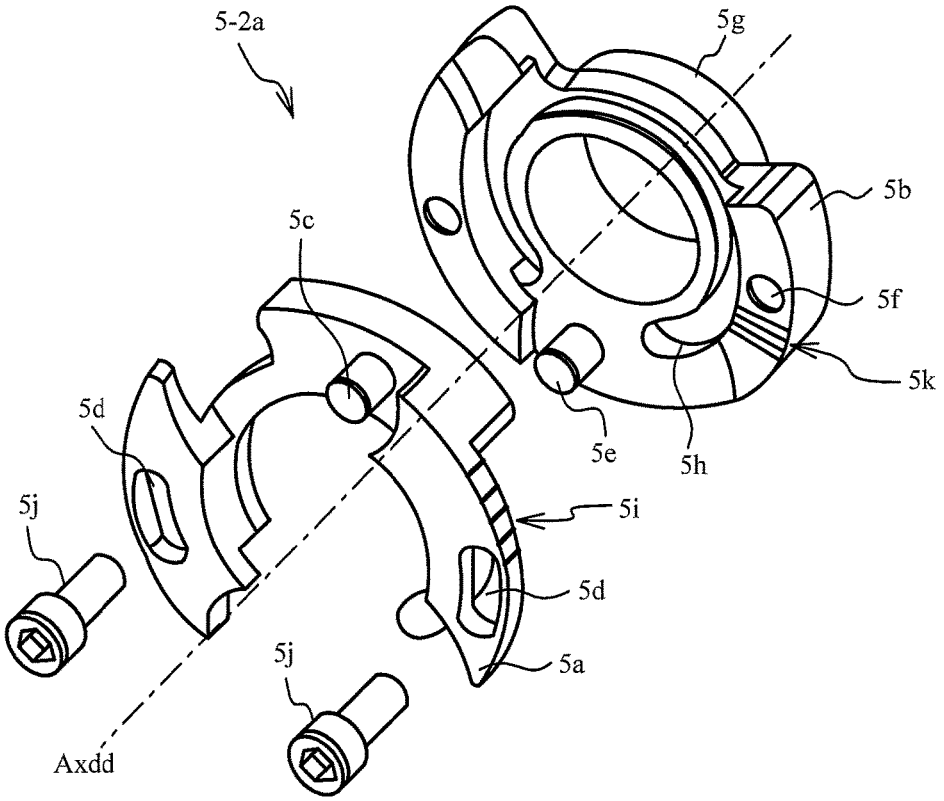
FIG. 25 is an exploded perspective view exemplary illustrating the drive disk of the variable valve device according to the first variation of the first embodiment.

FIG. 25 is an exploded perspective view exemplary illustrating the drive disk 5-2*a* of the variable valve device according to the first variation of the first embodiment. As illustrated in FIG. 25, a surface, of the driven side disk 5*b*, facing the drive side disk 5*a* is provided on projections 5*k*. The interval between the adjacent projections 5*k* is equivalent to, for example, from 0.5 degrees to 1 degree. Using the projections 5*k* enables the adjustment of the angle A between the pins.

Figure 26A:
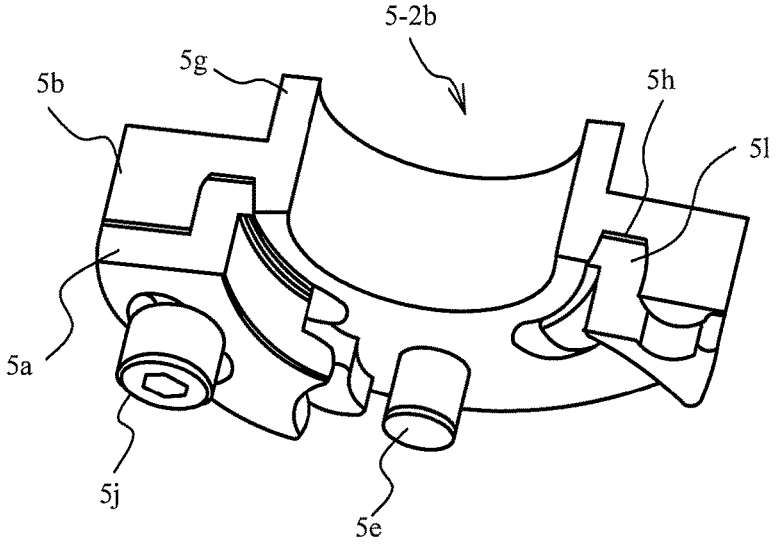
FIG. 26A is a perspective view exemplary illustrating a cross section of a drive disk of a variable valve device according to the second variation of the first embodiment.

FIG. 26A is a perspective view exemplary illustrating a cross section of a drive disk 5-2*b* of a variable valve device according to a second variation of the first embodiment. As illustrated in FIG. 26A, a tapered portion 5*l* of the drive side disk 5*a* engages the recess portion 5*h*. Thus, the drive side disk 5*a* is firmly secured to the driven side disk 5*b*.

Figure 26B:
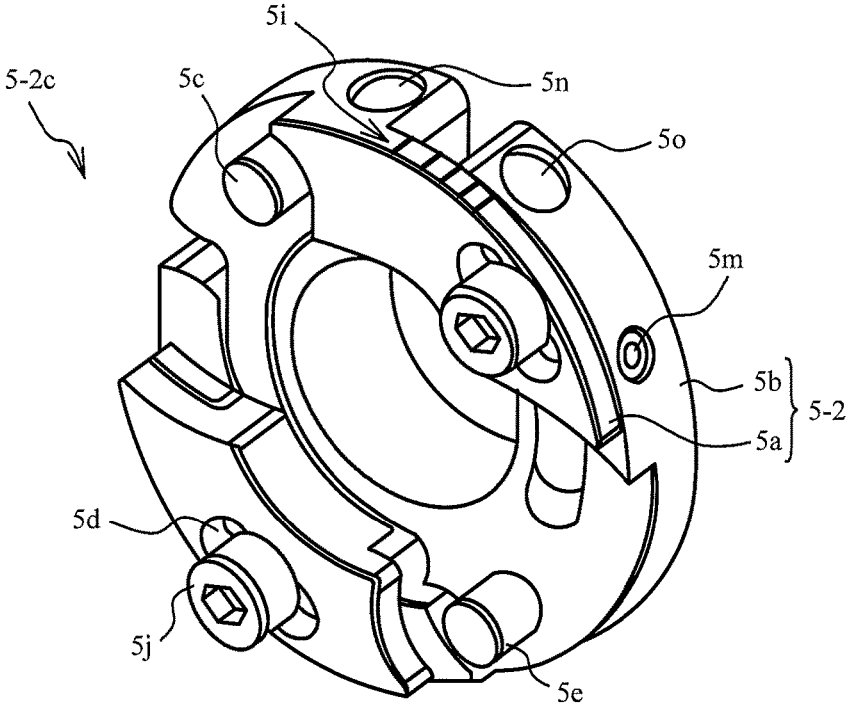
FIG. 26B is a perspective view exemplary illustrating a drive disk of a variable valve device according to the third variation of the first embodiment.

FIG. 26B is a perspective view exemplary illustrating a drive disk 5-2*c* of a variable valve device according to the third variation of the first embodiment. As illustrated in FIG. 26B, a screw 5*m* is inserted into the outer circumferential surface of the driven side disk 5*b*. The screw 5*m* secures the drive side disk 5*a* engaging the recess portion 5*h* of the driven side disk 5*b*. The securement between the disks may use, for example, an adhesive or the like. The outer circumferential surface of the drive side disk 5*a* is provided with a hole 5*n*, and the outer circumferential surface of the driven side disk 5*b* is provided with a hole 5*o*. The holes 5*n* and 5*o* will be described later.

Figure 27A:
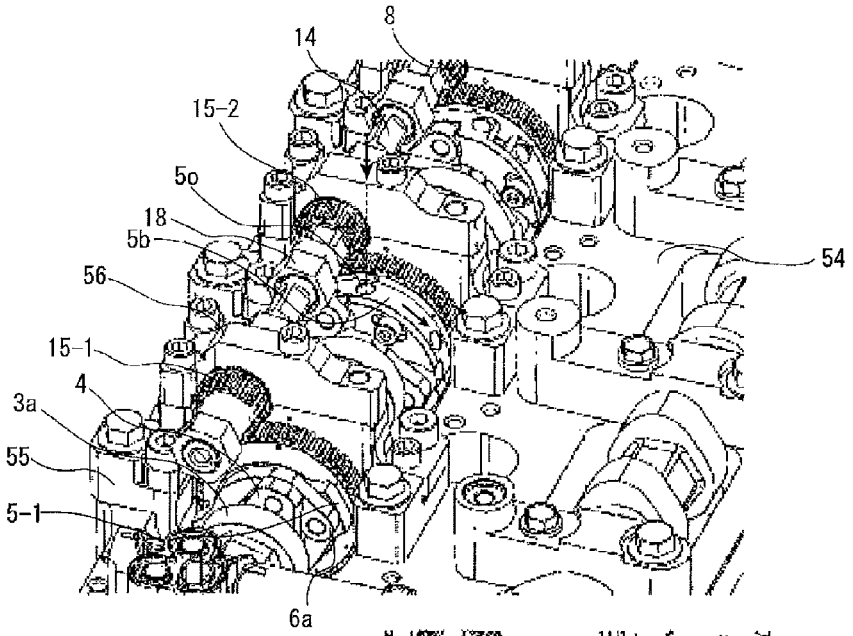
FIG. 27A and FIG. 27B are perspective views exemplary illustrating adjustment of an angle A between pins in the third variation.
Figure 27B:
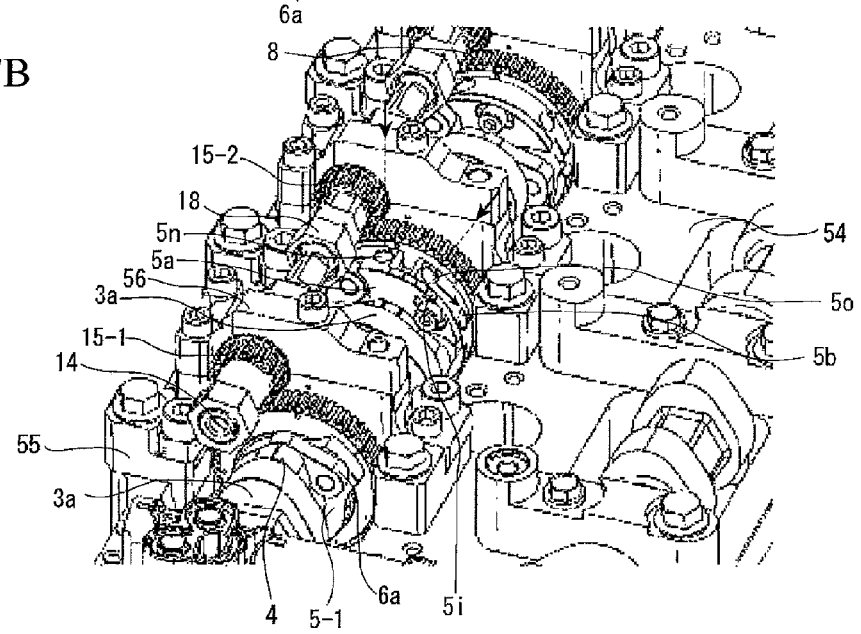

FIG. 27A and FIG. 27B are perspective views exemplary illustrating adjustment of an angle A between pins in the third variation. As illustrated in FIG. 27A, the driven side disk 5*b* is rotated by using a jig inserted into the hole 5*o*. It is thus possible to adjust the angle A between the pin. Further, as illustrated in FIG. 27B, the drive disk side 5*a* is secured by inserting the jig into the hole 5*n*. Afterward, the driven side disk 5*b* may be rotated.

Figure 28A:
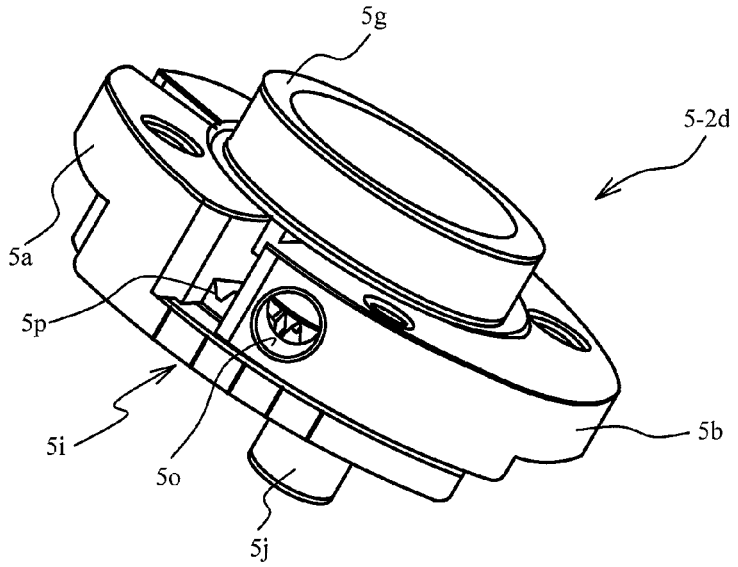
FIG. 28A is a perspective view exemplary illustrating a drive disk of a variable valve device according to the fourth variation.
Figure 28B:
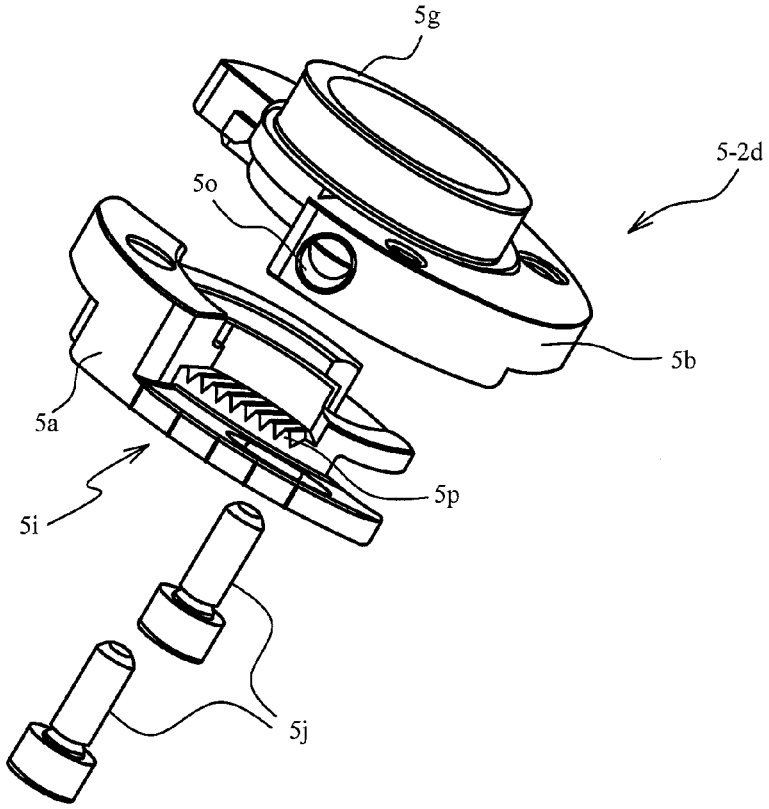
FIG. 28B is an exploded perspective view exemplary illustrating the drive disk.

FIG. 28A is a perspective view exemplary illustrating a drive disk 5-2*d* of a variable valve device according to the fourth variation. FIG. 28B is an exploded perspective view exemplary illustrating the drive disk 5-2*d*. As illustrated in FIG. 28A and FIG. 28B, a side, of the drive side disk 5*a*, facing the driven side disk 5*b* is provided with a gear portion 5*p*. The drive side disk 5*a* and the driven side disk 5*b* are assembled such that the gear portion 5*p* can be seen through the hole 5*o*.

Figure 29:
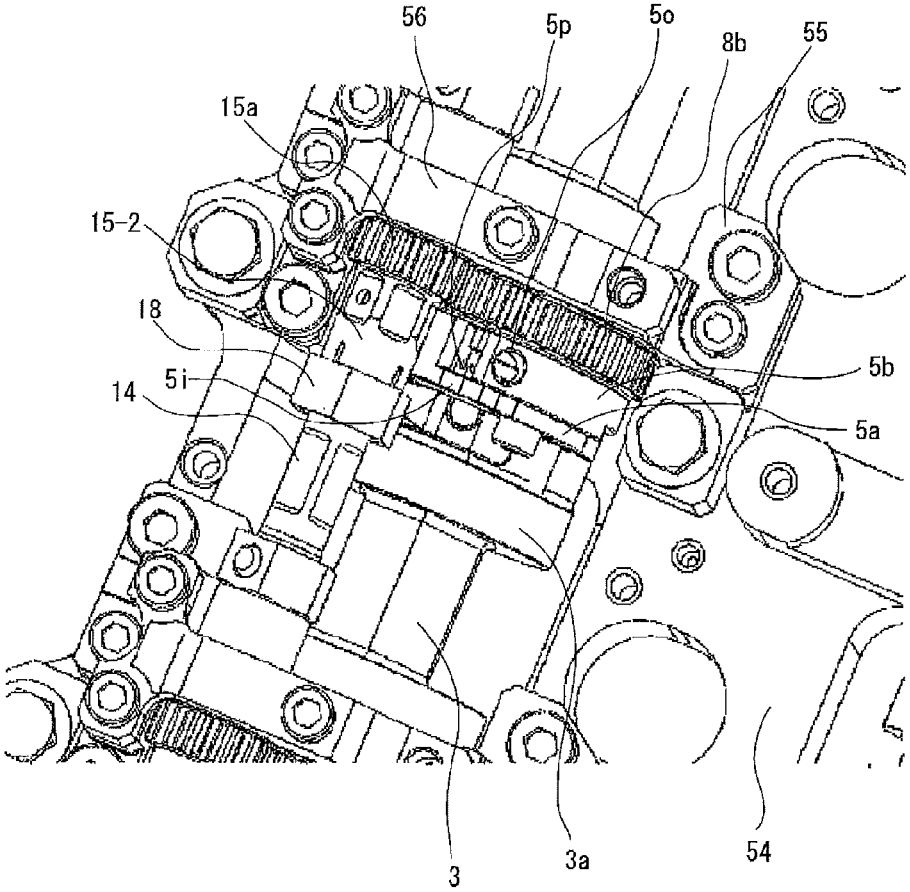
FIG. 29 is a top view exemplary illustrating adjustment of an angle A between the pins.

FIG. 29 is a top view exemplary illustrating adjustment of an angle A between the pins. The jig (not illustrated) is inserted into the hole 5*o* illustrated in FIG. 29, thereby connecting the jig and the gear portion 5*p*. Thus, rotating the driven side disk 5*b* can adjust the angle A between the pins. Preferably, the jig is provided with a gear engageable with the gear portion 5*p* or the like. This is because the rotation of the drive side disk 5*a* is facilitated.

The number of the bolts 5*j* is variable, and may be three or four. A nut for reinforcing the bolts 5*j* may be used. Also, the adhesive may be combined. The drive side disk 5*a* and the driven side disk 5*b* sandwiching a wear agent may be secured to each other. Also, the variation example may be combined.

The arrangement of parts of the variable valve device 1 may be varied. FIG. 30A to FIG. 30D are schematic views exemplary illustrating an example of the arrangement of the parts. The pin 5*c* which is a connection point of the drive disk and the first link member 6*a*, the pin 5*e* which is a connection point of the drive disk and the second link member 6*b*, the pin 7*a* which is a connection point of the first link member 6*a* and the drive arm portion 4, and the pin 7*b* which is a connection point of the second link member 6*b* and the cam shaft member 3 are each depicted by a black dot. The first link member 6*a* is depicted by a line between the pins 5*c* and 7*a*, and the second link member 6*b* is depicted by a line between the pins 5*e* and 7*b*. A dotted circle represents the rocker roller 52. As indicated by arrows R, the rotational direction is clockwise in the drawings.

Figure 30A:
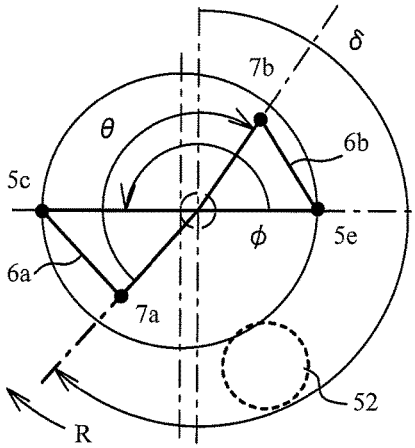
FIG. 30A to FIG. 30D are schematic views exemplary illustrating an example of the arrangement of parts.

FIG. 30A is a schematic view illustrating an example of the arrangement and illustrating the same arrangement as the first embodiment. In FIG. 30A, the pin 7*b* is positioned in the rotational direction side relative to the pin 5*c* between the pins 5*e* and 5*c*. The pin 7*a* is positioned in the rotational direction side relative to the pin 5*e* between the pins 5*c* and 5*e*. In opening the valve, the compressive force is generated such the drive arm portion 4 pushes the first link member 6*a* in the rotational direction against the spring force of the intake valve 53. Further, the tensile force is generated such that the second link member 6*b* pulls the cam shaft member 3 in the rotational direction. In closing the valve, the tensile force is generated by the spring force such that the first link member 6*a* pulls the drive arm portion 4, and the compressive force is generated such that the cam shaft member 3 pushes the second link member 6*b*.

Figure 30B:
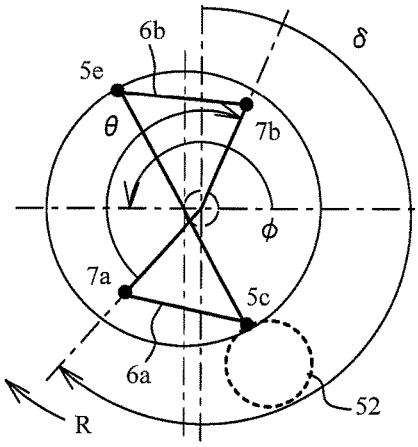

In the example in FIG. 30B, the pin 7*b* is positioned in the rotational direction side relative to the pin 5*e* between the pins 5*c* and 5*e*. The pin 7*a* is positioned in the rotational direction side relative to 5*c* between the pins 5*e* and 5*c*. In opening the valve, the tensile force is generated in the first link member 6*a*, and the compressive force is generated in the second link member 6*b*. In closing the valve, the compressive force is generated in the first link member 6*a*, and the tensile force is generated in the second link member 6*b*.

Figure 30C:
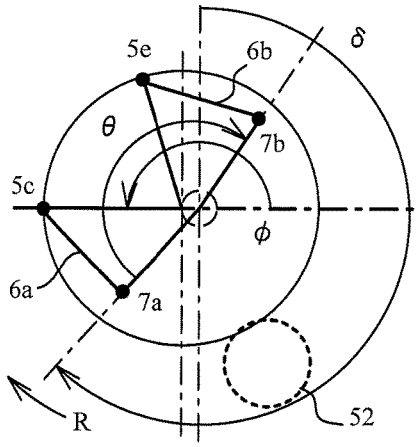

In the example in FIG. 30C, the pins 7*a* and 7*b* are positioned in the rotational direction side relative to the pin 5*e* between the pins 5*c* and 5*e*. The pins 7*a* and 7*b* are arranged in the order of being close to the pin 5*c*. In opening the valve, the compressive force is generated in the first link member 6*a* and the second link member 6*b*. In closing the valve, the tensile force is generated in the first link member 6*a* and the second link member 6*b*.

Figure 30D:
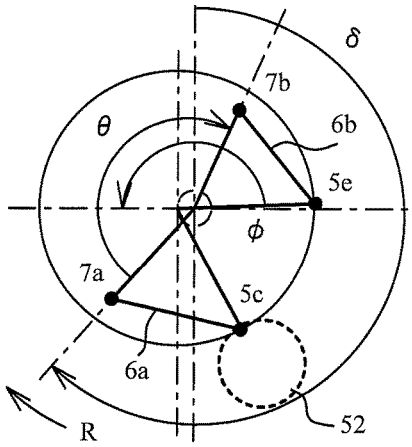

In the example in FIG. 30D, the pins 7*a* and 7*b* are positioned in the rotational direction side relative to the pin 5*c* between the pins 5*c* and 5*e*. The pins 7*a* and 7*b* are arranged in the order of being close to the pin 5*c*. In opening the valve, the tensile force is generated in the first link member 6*a* and the second link member 6*b*. In closing the valve, the compressive force is generated in the first link member 6*a* and the second link member 6*b*.

Depending on the arrangement of the intake valve 53, the lift property, the wear degree of parts, or the assemblability of parts, any one of the arrangements illustrated in FIG. 30A to FIG. 30D. In addition, the first embodiment is applicable to a variable valve device for opening and closing the exhaust valves.

While the exemplary embodiments of the present invention have been illustrated in detail, the present invention is not limited to the above-mentioned embodiments, and other embodiments, variations and variations may be made without departing from the scope of the present invention.

DESCRIPTION OF LETTERS OR NUMERALS

2 drive shaft member
3 cam shaft member
3*a* cam lobe
4 drive arm portion
5-1, 5-2 drive disk
5*a* drive side disk
5*b* driven side disk
5*c*, 5*e* pin
6*a* first link member
6*b* second link member
8 control sleeve
8*a* eccentric hole
8*b*, 15*a* gear portion
14 control shaft
15-1, 15-2 pinion

The invention claimed is:

1. A variable valve device comprising:

a drive shaft member rotating synchronously with a crankshaft provided in an internal combustion engine;

a cam shaft member including a cam lobe and rotatably provided about the drive shaft member;

a drive arm portion provided in the drive shaft member and rotating together with the drive shaft member;

a control sleeve provided with an eccentric hole into which the drive shaft member is inserted, and arranged to vary a position of a central axis of the eccentric hole; and a first rotary member including a first member connected to the drive arm portion and a second member connected to the cam shaft member, and rotating along an inner circumferential wall surface of the eccentric hole, wherein the first rotary member rotates in a state where the first member and the second member are secured to each other, a relative position between the first member and the second member about a central axis line of the drive shaft member is variable.

2. The variable valve device of claim 1, comprising:

a first link member connected to the drive arm portion and the first member; and a second link member connected to the cam shaft member and the second member, wherein an angle about the central axis line between a connection point of the first member and the first link member and a connection point of the second member and the second link member is variable.

3. The variable valve device of claim 1, wherein the cam shaft member, the drive arm portion, and the control sleeve are provided for every cylinder of the internal combustion engine, a second rotary member is provided to correspond to at least one of the cylinders, rotates along the inner circumferential wall surface of the eccentric hole, and is an integrated member, the first rotary member is provided to correspond to the cylinder other than the at least one of the cylinders.

4. The variable valve device of claim 3, wherein the control sleeve includes a first gear portion in an outer circumferential surface, the variable valve device comprising:

a control shaft facing in a direction same as a direction in which the drive shaft member faces;

a second gear portion corresponding to at least one of the cylinders, provided in an outer circumference of the control shaft, engageable with the first gear portion, and secured to the control shaft; and a third gear portion corresponding to the cylinder other than the at least one of the cylinders among the cylinders, provided in the outer circumference of the control shaft, engageable with the first gear portion, and rotatable about a central axis line of the control shaft independently of the second gear portion.

* * * * *